US009244416B2

(12) United States Patent
Ito et al.

(10) Patent No.: US 9,244,416 B2
(45) Date of Patent: Jan. 26, 2016

(54) APPARATUS FOR MEASURING DEPOSITED TONER AMOUNT COMMONLY FOR THICKNESS AND AREA DETERMINING REGIONS

(71) Applicant: STANLEY ELECTRIC CO., LTD., Meguro-ku, Tokyo (JP)

(72) Inventors: Tokuhiko Ito, Yokohama (JP); Fumio Ogawa, Yokosuka (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/550,911

(22) Filed: Nov. 21, 2014

(65) Prior Publication Data

US 2015/0153680 A1 Jun. 4, 2015

(30) Foreign Application Priority Data

Nov. 29, 2013 (JP) ..... 2013-248119

(51) Int. Cl.
*G03G 15/00* (2006.01)

(52) U.S. Cl.
CPC ..... *G03G 15/5058* (2013.01); *G03G 15/5041* (2013.01)

(58) Field of Classification Search
CPC ..... G03G 15/5058; G03G 15/5041
USPC ..... 399/49, 72
See application file for complete search history.

(56) References Cited

U.S. PATENT DOCUMENTS 7,953,334 B2 * 5/2011 Shida ..... 399/49

FOREIGN PATENT DOCUMENTS

JP 2010152138 A 7/2010

* cited by examiner

*Primary Examiner* — Hoang Ngo
(74) *Attorney, Agent, or Firm* — Holtz, Holtz & Volek PC

(57) ABSTRACT

In an apparatus for measuring a deposited toner amount of a toner patch formed on a toner carrier, an intersection between a light outgoing and incoming plane including an optical axis of the light emitting portion and light receiving portion of an optical sensor and a surface of the toner carrier is perpendicular to a direction of propagation thereof. The light outgoing and incoming plane is inclined at a mounting angle toward the direction of propagation of the toner carrier with respect to a plane including the intersection. A control unit calculates the deposited toner amount in accordance with one of a peak value and a bottom value of a sense voltage in a thickness determining region and calculates the deposited toner amount in accordance with the other of the peak value and the bottom value in an area determining region.

13 Claims, 25 Drawing Sheets

71
(M)
W=0.3mg/cm²
t=11μm
W=0.6mg/cm²
t=13μm
W=0.7mg/cm²
t=19μm
W=0.9mg/cm²
t=25μm
W=1.2mg/cm²
t=35μm
ADR
TDR
PM=0.05
PM=0.05
PM=0.4
PM=1.0
PM=1.6
Vs
BM
LR

71'
(M)
W=0mg/cm²
t=0μm
W=0.1mg/cm²
t=11μm
W=0.3mg/cm²
t=11μm
W=0.6mg/cm²
t=13μm
ADR
LR
Vs
PM=0
BM=0
PM=0.05
BM=0.3
BM=0.8
BM=1.6

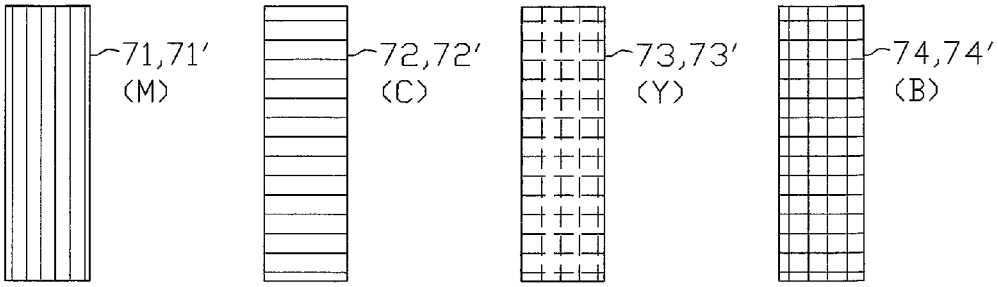
Fig.10A
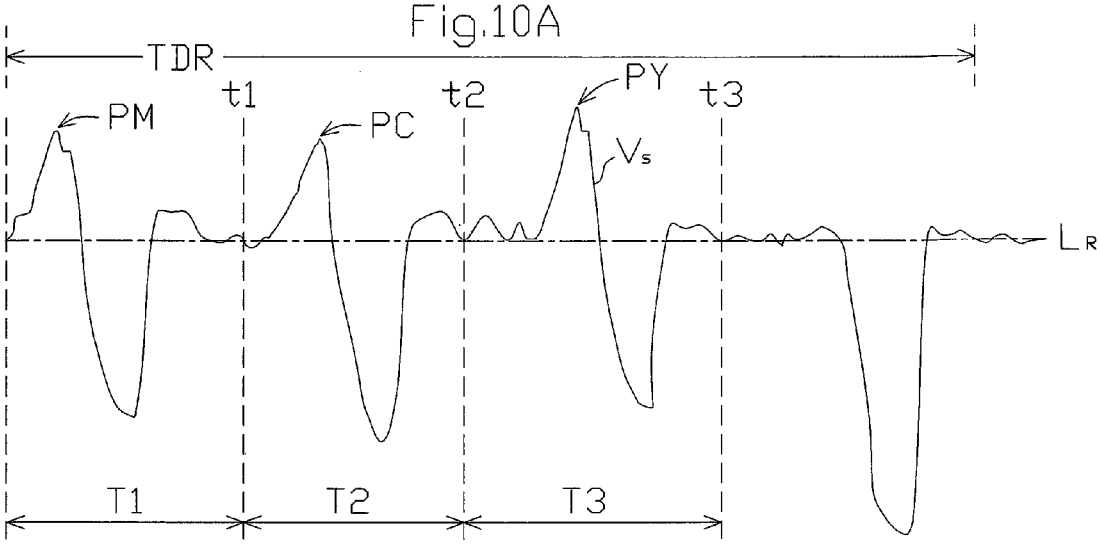
Fig.10B
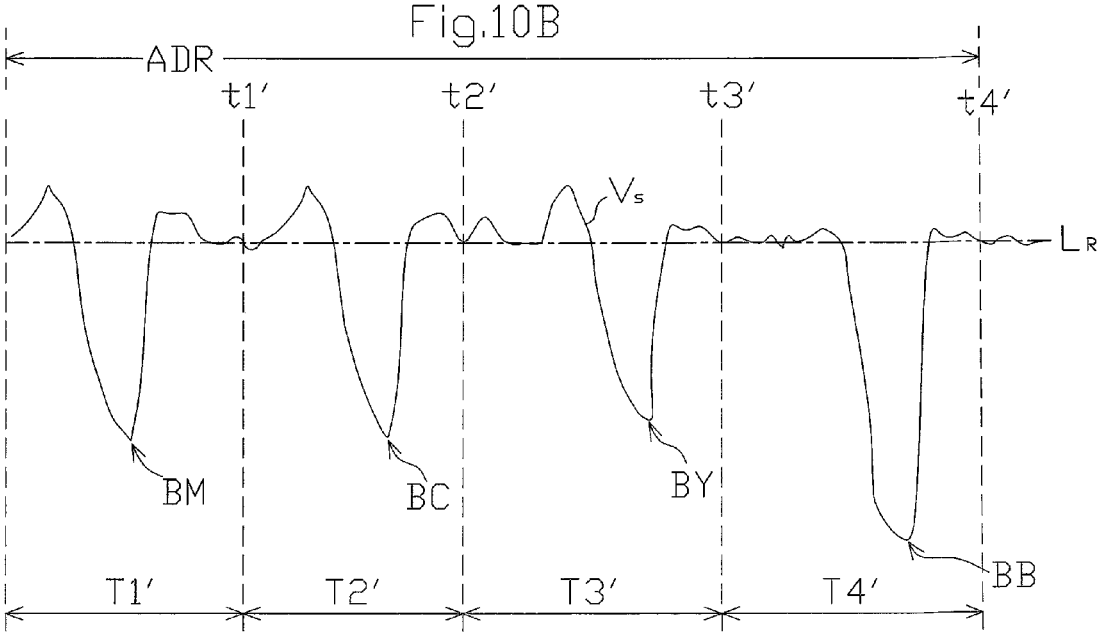

71,71′
(M)
72,72′
(C)
73,73′
(Y)
74,74′
(B)
TDR

PM
t1
PC
t2
PY
t3
LR
Vs

PM′
PC′
PY′
LR
V′s
T1
T2
T3
ADR t1′
t2′
t3′
t4′
LR
V′s
BM
BC
BY
BB
T1′
T2′
T3′
T4′

APPARATUS FOR MEASURING DEPOSITED TONER AMOUNT COMMONLY FOR THICKNESS AND AREA DETERMINING REGIONS

This application claims the priority benefit under 35 U.S.C. §119 to Japanese Patent Application No. JP2013-248119 filed on Nov. 29, 2013, which disclosure is hereby incorporated in its entirety by reference.

BACKGROUND

1. Field

The presently disclosed subject matter relates to a multi-color image forming apparatus such as a color electro-photographic printer, a color laser beam printer and a color print machine, and, more particularly, to an apparatus for measuring a deposited toner amount in a multi-color image forming apparatus.

2. Description of the Related Art

Generally, a multi-color image forming apparatus reproduces a clear image in accordance with a full-color mode, a monochromatic color mode, or a black and white print mode. For this purpose, toner rectangles or patches having predetermined amounts of magenta toner, predetermined amounts of cyan toner, predetermined amounts of yellow toner and predetermined amounts of black toner are deposited in advance to a toner carrier or a transfer belt. Then, the predetermined amounts of deposited toner of the patches are measured by a deposited toner amount measuring apparatus to thereby fine-adjust the charging process, the exposing process, the developing process, the transferring process, the fixing process and the like.

A prior art deposited toner amount measuring apparatus detects light reflected from a toner patch on a transfer belt irradiated with light, and measures a thickness of deposited toner in accordance with the difference between the height of the transfer belt at edges of the toner patch and the height of the toner patch. Thus, a thickness of deposited toner as the deposited toner amount can be measured regardless of a wavelike movement, roughness and fluttering of the transfer belt (see: JP2010-152138A).

In the above-described prior art deposited toner amount measuring apparatus, however, only a large amount of deposited toner can be measured, which is discussed below.

That is, in a thickness determining region TDR where a toner patch TP1 has a deposited toner amount W not smaller than 0.6 mg/cm$^2$, for example, as illustrated in FIG. 21, the transfer belt (toner carrier) beneath the toner patch TP1 is entirely covered by toner particles thereof, so that the thickness "t" of deposited toner at the toner patch TP1 is proportional to the deposited toner amount W at the toner patch TP1 as illustrated in FIG. 23. Note that the deposited toner thickness "t" is increased at inner portions having a width of about 1 to 1.5 mm from the edges of the toner patch TP1, to improve the accuracy of the deposited toner thickness "t" by measuring them at such inner portions.

On the other hand, in an area determining region ADR where a toner patch TP2 has a deposited toner amount W smaller than 0.6 mg/cm$^2$, for example, as illustrated in FIG. 22, the transfer belt (toner carrier) beneath the toner patch TP2 is not entirely covered by toner particles thereof, so that the thickness "t" of deposited toner at the toner patch TP2 is constant regardless of the deposited toner amount W at the toner patch TP2 as illustrated in FIG. 23.

In FIGS. 21 and 22, note that $L_R$ designates a reflection reference level at the transfer belt.

Thus, the above-described prior art deposited toner amount measuring apparatus measures only deposited toner amounts W in the thickness determining region TDR (W≥0.6 mg/cm$^2$); however, the above-described prior art deposited toner amount measuring apparatus would not measure deposited toner amount W in the area determining region ADR (W<0.6 mg/cm$^2$). If it is required to measure deposited toner amount W in the area determining region ADR, an additional deposited toner amount measuring apparatus is required, which would increase the manufacturing cost.

Additionally, the above-described prior art deposited toner amount measuring apparatus requires a line sensor and a specific optical system, which also would increase the manufacturing cost.

SUMMARY

The presently disclosed subject matter seeks to solve one or more of the above-described problems.

According to the presently disclosed subject matter, in an apparatus for measuring a deposited toner amount of a toner patch formed on a toner carrier, an optical sensor having a light emitting portion and a light receiving portion, and a control unit adapted to drive the light emitting portion to receive a sense voltage from the light receiving portion are provided. An intersection between a light outgoing and incoming plane including the optical axis of the light emitting portion and the light receiving portion and a surface of the toner carrier is perpendicular to a direction of propagation thereof. The light outgoing and incoming plane is inclined at a mounting angle toward the direction of propagation of the toner carrier with respect to a plane including the intersection. The control unit calculates the deposited toner amount in accordance with one of a peak value and a bottom value of the sense voltage in a thickness determining region and calculates the deposited toner amount in accordance with the other of the peak value and the bottom value of the sense voltage in an area determining region.

According to the presently disclosed subject matter, a deposited toner amount in a thickness determining region and a deposited toner amount in an area determining region can be measured by a single deposited toner amount measuring apparatus.

BRIEF DESCRIPTION OF THE DRAWINGS

The above and other advantages and features of the presently disclosed subject matter will be more apparent from the following description of certain embodiments, as compared with the prior art, taken in conjunction with the accompanying drawings, wherein:

FIG. 10A is a timing diagram of the sense voltage of the optical sensor for supplementing the operation of FIG. 9 in the thickness determining region;

FIG. 10B is a timing diagram of the sense voltage of the optical sensor for supplementing the operation of FIG. 9 in the area determining region;

DETAILED DESCRIPTION OF EXEMPLARY EMBODIMENTS

Figure 1:
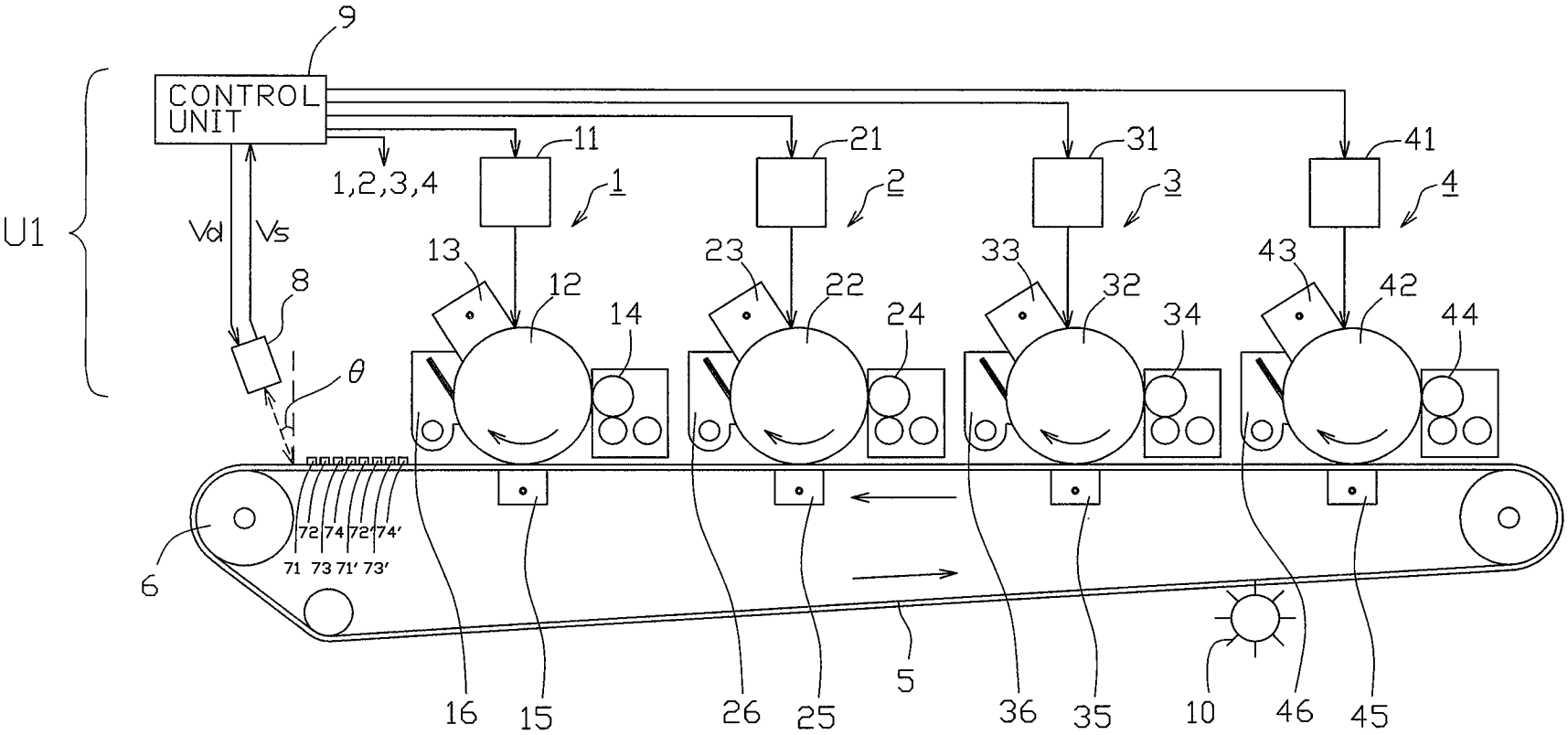
FIG. 1 is a diagram illustrating a multi-color image forming apparatus including a first embodiment of the deposited toner amount measuring apparatus according to the presently disclosed subject matter.

In FIG. 1, which illustrates a multi-color image forming apparatus such as a four-drum color laser beam printer including a first embodiment of the deposited toner amount measuring apparatus according to the presently disclosed subject matter, four color image forming units, i.e., a magenta image forming unit 1, a cyan image forming unit 2, a yellow image forming unit 3 and a black image forming unit 4 are provided.

The magenta image forming unit 1 is constructed by an ON/OFF optical signal generating section 11 having a laser oscillator, a polygon mirror, reflection mirrors and the like, a photo drum 12, a charger 13, a developer 14, a transfer unit 15, and a cleaner 16.

The cyan image forming unit 2 is constructed by an ON/OFF optical signal generating section 21 having a laser oscillator, a polygon mirror, reflection mirrors and the like, a photo drum 22, a charger 23, a developer 24, a transfer unit 25, and a cleaner 26.

The yellow image forming unit 3 is constructed by an ON/OFF optical signal generating section 31 having a laser oscillator, a polygon mirror, reflection mirrors and the like, a photo drum 32, a charger 33, a developer 34, a transfer unit 35, and a cleaner 36.

The black image forming unit 4 is constructed by an ON/OFF optical signal generating section 41 having a laser oscillator, a polygon mirror, reflection mirrors and the like, a photo drum 42, a charger 43, a developer 44, a transfer unit 45, and a cleaner 46.

On the other hand, a transfer belt 5 is provided between the photo drums 12, 22, 32 and 42 and the transfers 15, 25, 35 and 45 to carry transfer members such as paper and toner. The transfer belt 5 is driven in an arrow-indicated direction by a drive roller 6. The photo drums 12, 22, 32 and 42 are provided equidistantly on the transfer belt 5.

For example, a magenta image transfer operation carried out by the magenta image forming unit 1 is explained below.

First, the surface of the photo drum 12 is charged uniformly by the charger 13.

Next, the surface of the photo drum 12 is scanned along its rotational axis by an ON/OFF optical signal of the ON/OFF optical signal generating section 11, so that a magenta electrostatic latent image is formed on the surface of the photo drum 12.

Next, magenta toner is deposited by the developer 14 on the electrostatic latent image on the surface of the photo drum 12, to form a magenta toner pattern.

Similarly, a cyan toner pattern, a yellow toner pattern and a black toner pattern are formed by the cyan image forming unit 2, the yellow image forming unit 3 and the black image forming unit 4, respectively.

The magenta toner pattern, the cyan toner pattern, the yellow toner pattern and the black toner pattern are sequentially transferred to the transfer member or paper by the transfer units 15, 25, 35 and 45, respectively.

Finally, the magenta toner pattern, the cyan toner pattern, the yellow toner pattern and the black toner pattern are thermally fixed by a fixer (not shown) on the transfer belt 5.

In the multi-color image forming apparatus of FIG. 1, in order to fine-adjust the magenta image forming unit 1, the cyan image forming unit 2, the yellow image forming unit 3 and the black image forming unit 4, a high accuracy of measurement is required among magenta toner patches, cyan toner patches, yellow toner patches and black toner patches on the transfer member or paper.

That is, a magenta toner patch 71, a cyan toner patch 72, a yellow toner patch 73 and a black toner patch 74 in the thickness determining region TDR are formed on the transfer belt 5 by the magenta image forming unit 1, the cyan image forming unit 2, the yellow image forming unit 3, and the black image forming unit 4, respectively. Also, a magenta toner patch 71', a cyan toner patch 72', a yellow toner patch 73' and a black toner patch 74' in the area determining region ADR are formed on the transfer belt 5 by the magenta image forming unit 1, the cyan image forming unit 2, the yellow image forming unit 3 and the black image forming unit 4, respectively. The magenta toner patches 71 and 71' are made of magenta toner M, the cyan toner patches 72 and 72' are made of cyan toner C, the yellow toner patches 73 and 73' are made of yellow toner Y, and the black toner patches 74 and 74' are made of black toner B. These patches 71, 72, 73, 74, 71', 72', 73' and 74' have the same shape as each other and are detected by an optical sensor 8. A control unit 9 generates a drive voltage $V_d$ and transmits it to the optical sensor 8, to thereby fine-adjust the magenta image forming unit 1, the cyan image forming unit 2, the yellow image forming unit 3 and the black image forming unit 4 in accordance with a sense voltage $V_s$ of the optical sensor 8.

In FIG. 1, note that two magenta toner patches 71 and 71', two cyan toner patches 72 and 72', two yellow toner patches 73 and 73' and two black toner patches 74 and 74' are illustrated; however, an arbitrary number of toner patches from the thickness determining region TDR to the area determining region ADR can be provided.

Note that, after the fine-adjustment of the magenta image forming unit 1, the cyan image forming unit 2, the yellow image forming unit 3 and the black image forming unit 4 is completed, the unnecessary color toner patches 71, 72, 73, 74, 71', 72', 73' and 74' are removed by a transfer belt cleaner blade 10.

The optical sensor 8 and the control unit 9 constitute a deposited toner amount measuring apparatus U1.

The optical sensor 8 of FIG. 1 is explained below with reference to FIGS. 2A, 2B and 2C which are a front view, a bottom view and a side view, respectively, of the optical sensor 8.

Figure 2A:
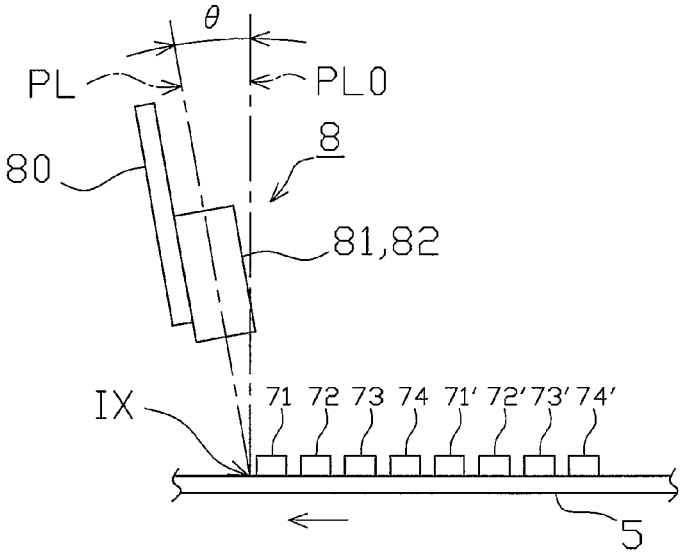
FIGS. 2A, 2B and 2C are a front view, a bottom view and a side view, respectively, of the optical sensor of FIG. 1.
Figure 2B:
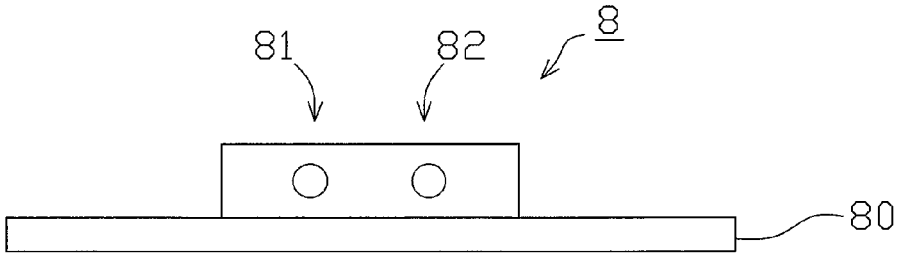
Figure 2C:
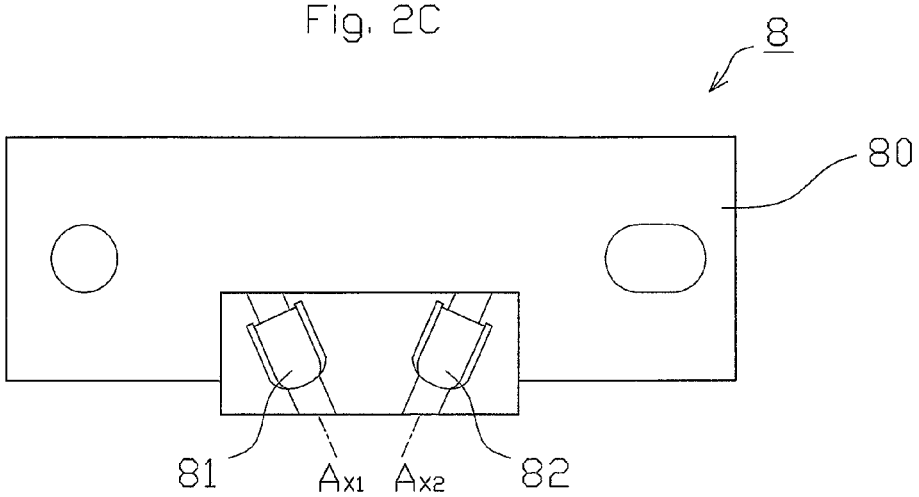

As illustrated in FIGS. 2A, 2B and 2C, the optical sensor 8 is constructed by a substrate 80, a light emitting diode (LED) element 81 as a light emitting portion on the substrate 80, and a photodiode (PD) element 82 or a phototransistor as a light receiving portion on the substrate 80. An intersection IX between a light outgoing and incoming plane PL including optical axes $A_{x1}$ and $A_{x2}$ of the LED element 81 and the PD element 82 and a surface of the transfer belt 5 is perpendicular to the direction of propagation of the transfer belt 5, i.e., the magenta toner patch 71, the cyan toner patch 72, the yellow toner patch 73, the black toner patch 74, the magenta toner patch 71', the cyan toner patch 72', the yellow toner patch 73' and the black toner patch 74'. Also, the light outgoing and incoming plane PL is inclined at a mounting angle θ toward the direction of propagation of the transfer belt 5 with respect to a plane PL0 including the above-mentioned intersection IX perpendicular to the transfer belt 5. Thus, the optical sensor 8 is strongly subject to light reflected from leading edges of the toner patches 71, 72, 73, 74, 71', 72', 73' and 74', but is less subject to light reflected from the transfer belt 5.

Figure 3:
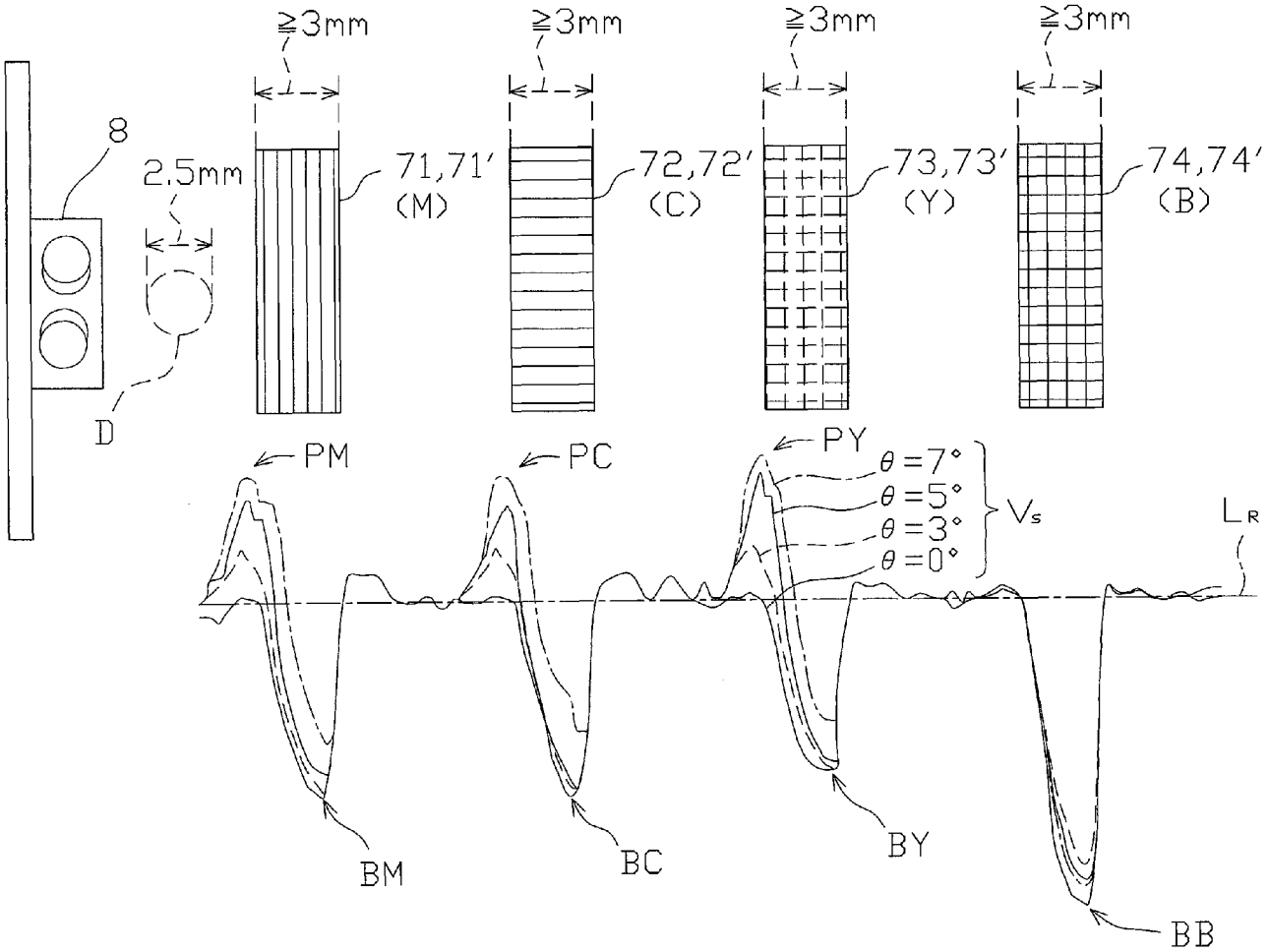
FIG. 3 is a timing diagram of the sense voltage of the optical sensor for explaining the mounting angle of the optical sensor of FIG. 2.

FIG. 3 is a timing diagram of the sensor voltage $V_s$ of the optical sensor 8 for explaining the mounting angle θ of the optical sensor 8 of FIG. 2.

In FIG. 3, each of the magenta toner patches 71 and 71', the cyan toner patches 72 and 72', the yellow toner patches 73 and 73' and the black toner patches 74 and 74' is of a rectangular shape with a length not smaller than 3 mm along the direction of propagation of the transfer belt 5 and a thickness of 25 μm, for example. Also, the detection area D of the optical sensor 8 is about 1.5 to 4 mm in diameter, preferably, 2.5 mm in diameter. Thus, small ripple noises superposed onto the sense voltage $V_s$ of the optical sensor 8 can be suppressed.

When the magenta toner patch 71 (71'), the cyan toner patch 72 (72') and the yellow toner patch 73 (73') start to enter the detection area D, the sense voltage $V_s$ starts to rise from the reflection reference level $L_R$ to exhibit peak values PM, PC and PY in accordance with the mounting angle θ=0°, 3°, 5° and 7°. On the other hand, when the magenta toner patch 71 (71'), the cyan toner patch 72 (72'), the yellow toner patch 73 (73') and the black toner patch 74 (74') completely enter the detection area D, the sense voltage $V_s$ starts to fall from the reflection reference level $L_R$ due to the diffusion reflection by the toner particles of the magenta toner patch 71 (71'), the cyan toner patch 72 (72'), the yellow toner patch 73 (73') and the black toner patch 74 (74') to exhibit bottom values BM, BC, BY and BB. Thus, the sense voltage $V_s$ of the optical sensor 8 exhibits a ripple waveform formed by the peak value PM and the bottom value BM for the magenta toner patch 71 (71'), a ripple waveform formed by the peak value PC and the bottom value BC for the cyan toner patch 72 (72') and a ripple waveform formed by the peak value PY and the bottom value BY for the yellow toner patch 73 (73'). On the other hand, the sense voltage $V_s$ of the optical sensor 8 exhibits no peak value for the black toner patch 74 (74') resulting in no ripple waveform.

In order to measure deposited toner amounts W 0.6 mg/cm$^2$) of the magenta toner patch 71, the cyan toner patch 72 and the yellow toner patch 73 in the thickness determining region TDR, the mounting angle θ of the optical sensor 8 is about 5° to 7°, preferably, 5° to receive light reflected from the leading edges of the patches 71, 72 and 73. On the other hand, in order to measure deposited toner amounts W (<0.6 mg/cm$^2$) of the magenta toner patch 71', the cyan toner patch 72', the yellow toner patch 73' and the black toner patch 74' in the area determining region ADR, the mounting angle θ of the optical sensor 8 is preferably 0°; however, in this case, the mounting angle θ of the optical sensor 8 can be 0° to 7° so that the optical sensor 8 serves as a regular reflection sensor.

Thus, when 5° is set in the mounting angle θ of the optical sensor 8, deposited toner amounts W both in the thickness determining region TDR and in the area determining region ADR can be measured by the optical sensor 8.

FIGS. 4A, 4B, 4C, 4D and 4E are diagrams for explaining a relationship among the deposited toner amount W (≥0.6 mg/cm$^2$) and the deposited toner thickness "t" of the magenta toner patch 71 of FIG. 3 in the thickness determining region TDR and the peak value PM of the sense voltage $V_s$ of the optical sensor 8. In FIGS. 4A, 4B, 4C, 4D and 4E, assume that the mounting angle θ of the optical sensor 8 is 5°.

As illustrated in FIGS. 4B, 4C, 4D and 4E, when the deposited toner amount W is 0.6 mg/cm$^2$, 0.7 mg/cm$^2$, 0.9 mg/cm$^2$ and 1.2 mg/cm$^2$, the deposited toner thickness "t" is 13 μm, 19 μm, 25 μm and 35 μm, respectively, and the peak value PM relative to the reflection reference level $L_R$ is 0.05, 0.4, 1.0 and 1.6, respectively, while the bottom value BM relative to the reflection reference level $L_R$ is constant.

Figures 4A, 4B, 4C, 4D, 4E:
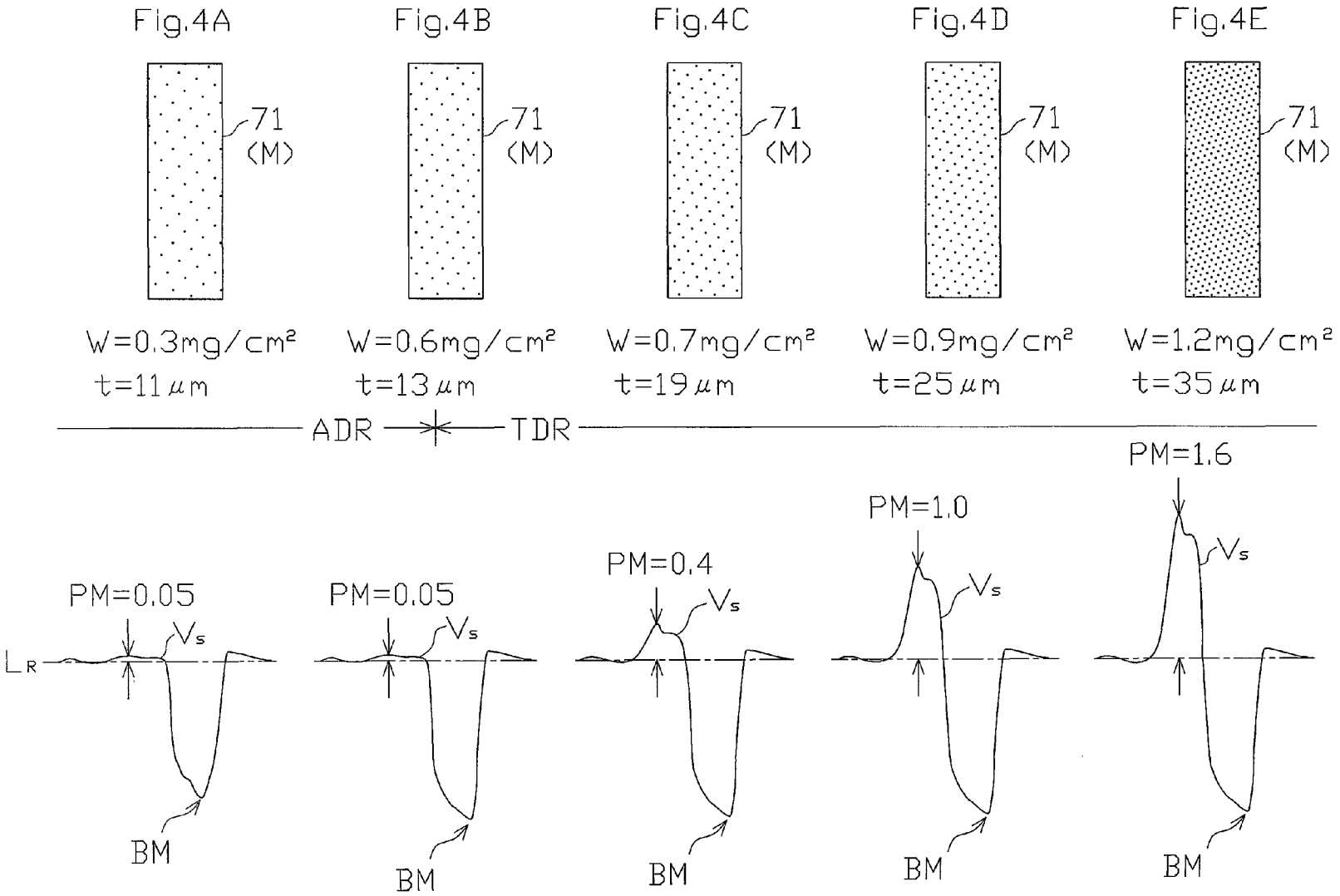
FIGS. 4A, 4B, 4C, 4D and 4E are diagrams for explaining a relationship among the deposited toner amount and the deposited toner thickness of the magenta toner patch of FIG. 3 in a thickness determining region and the peak value of the sense voltage of the optical sensor.

In FIG. 4A, when the deposited toner amount W is 0.3 mg/cm$^2$ in the area determining region ADR, the deposited toner thickness "t" is 11 μm, a little smaller than 13 μm, and the peak value PM is the same as that (=0.05) at W=0.6 mg/cm$^2$; however, the bottom value BM relative to the reflection reference level $L_R$ is decreased.

Figure 5A:
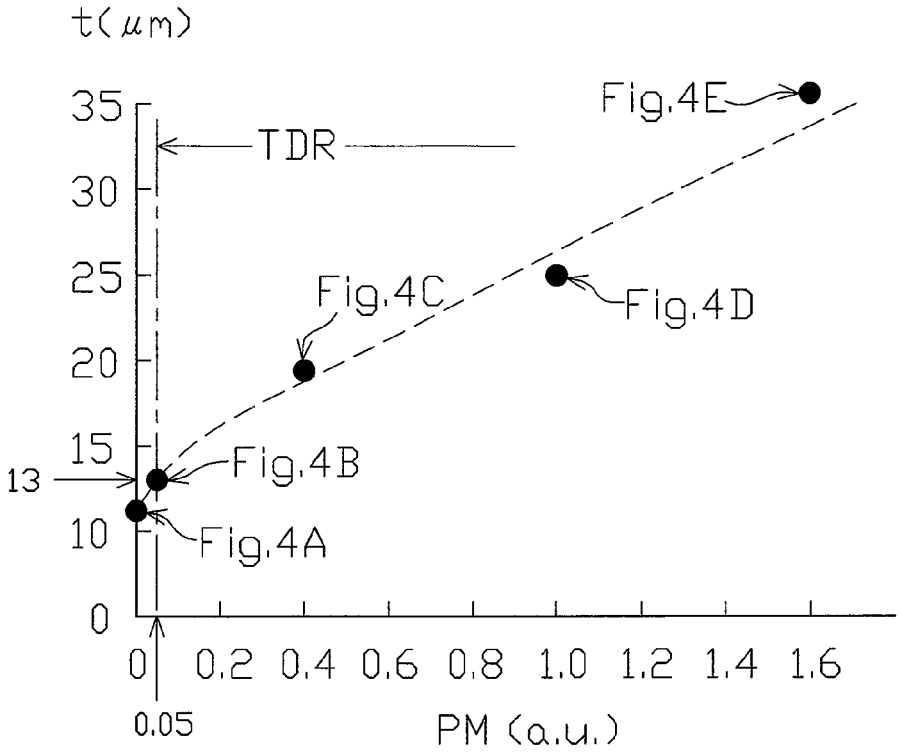
FIG. 5A is a graph for explaining a relationship between the peak value of the sense voltage of the optical sensor of FIG. 3 and the deposited toner thickness in a thickness determining region.
Figure 23:
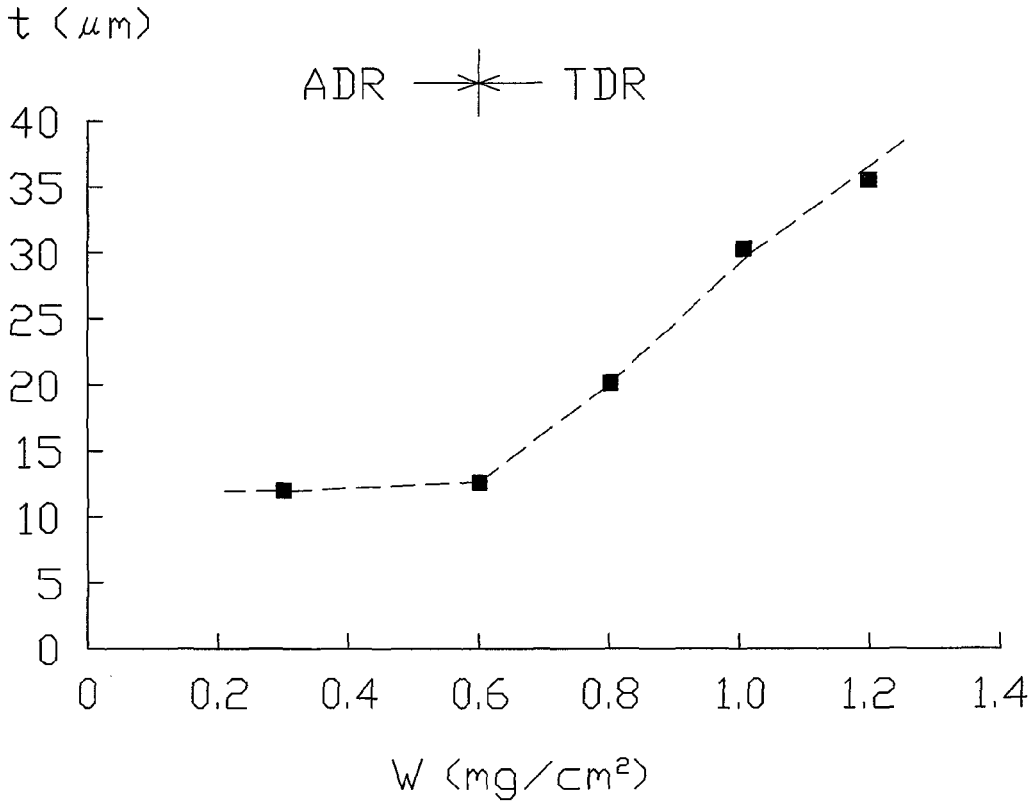
Fig. 23 PRIOR ART
FIG. 23 is a graph showing a relationship between a deposited toner amount and its thickness of a toner patch.

Therefore, in the thickness determining region TDR as illustrated in FIG. 5A, the deposited toner thickness "t" has a linear relationship with the peak value PM of the optical sensor 8. Also, in the thickness determining region TDR as illustrated in FIG. 23, the deposited toner thickness "t" has a linear relationship with the deposited toner amount W. Therefore, in the thickness determining region TDR as illustrated in FIG. 5B, the deposited toner amount W has a PM-to-W linear relationship with the peak value PM of the optical sensor 8.

Figure 5B:
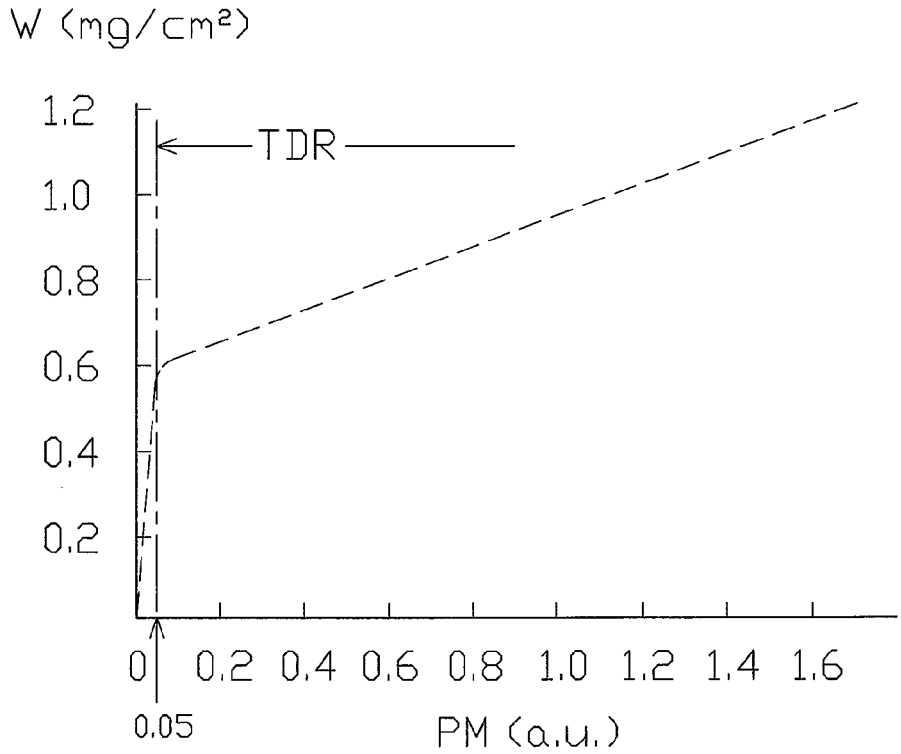
FIG. 5B is a graph for explaining a relationship between the peak value of the sense voltage of the optical sensor of FIG. 3 and the deposited toner amount in a thickness determining region.

Also, the deposited toner amount W of the cyan toner patch 72 has a PC-to-W linear relationship with the peak value PC of the optical sensor 8 similar to the PM-to-W linear relationship as illustrated in FIG. 5B, and the deposited toner amount W of the yellow toner patch 73 has a PY-to-W linear relationship with the peak value PY of the optical sensor 8 similar to the PM-to-W linear relationship as illustrated in FIG. 5B.

The above-mentioned linear relationships of deposited toner amounts W with the peak values PM, PC and PY of the sense voltage $V_s$ of the optical sensor 8 are stored in advance in the ROM 92 (see FIG. 8) of the control unit 9 of FIG. 1.

FIGS. 6A, 6B, 6C and 6D are diagrams for explaining a relationship among the deposited toner amount W (≤0.6 mg/cm$^2$) and the deposited toner thickness "t" of the magenta toner patch 71' of FIG. 3 in the area determining region ADR and the bottom value BM of the sense voltage $V_s$ of the optical sensor 8. Also, in FIGS. 6A, 6B, 6C and 6D, assume that the mounting angle θ of the optical sensor 8 is 5°.

Figures 6A, 6B, 6C, 6D:
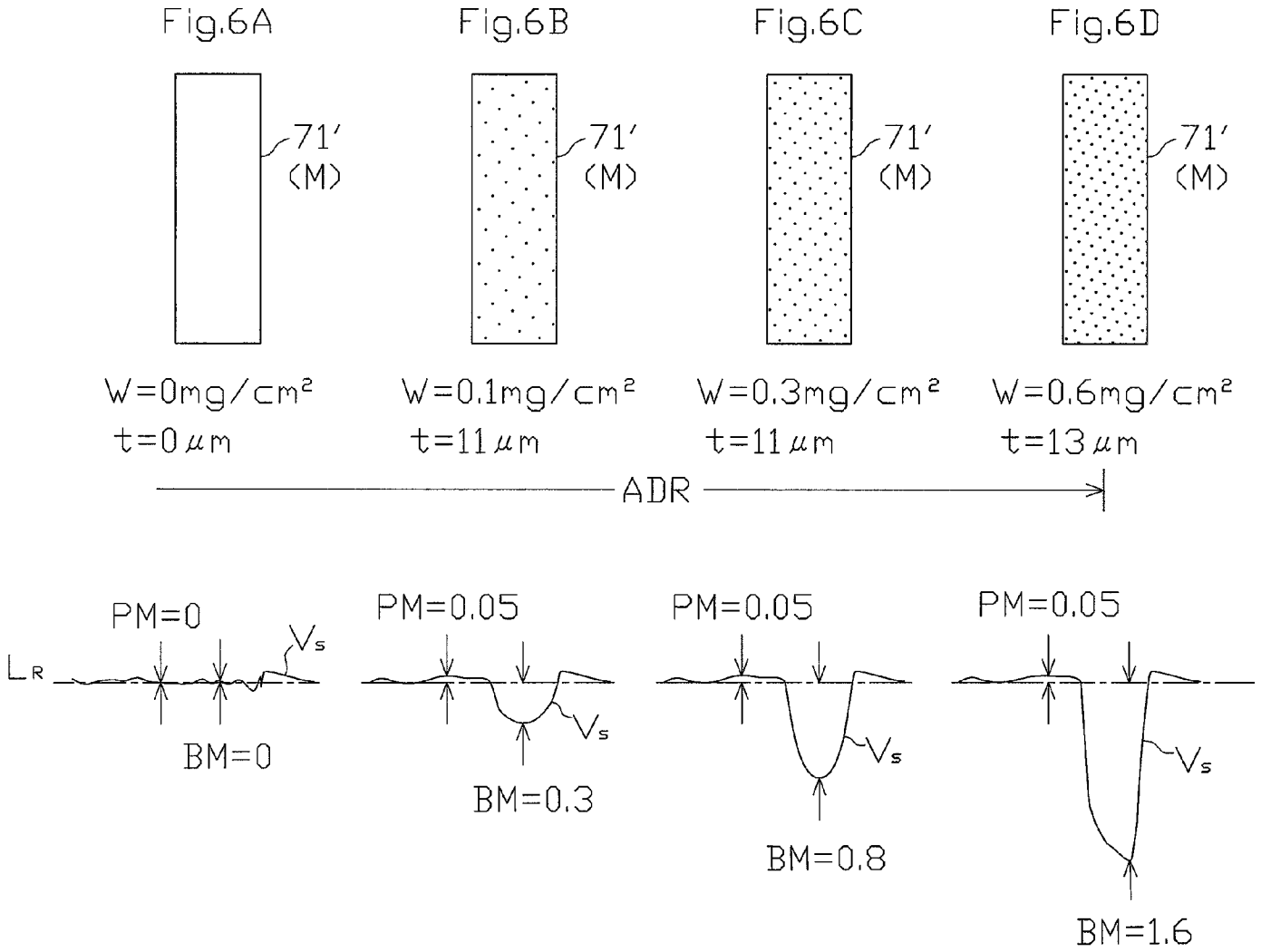
FIGS. 6A, 6B, 6C and 6D are diagrams for explaining a relationship among the deposited toner amount and the deposited toner thickness of the magenta toner patch of FIG. 3 in an area determining region and the bottom value of the sense voltage of the optical sensor.

As illustrated in FIGS. 6B, 6C and 6D, when the deposited toner amount W is 0.1 mg/cm$^2$, 0.3 mg/cm$^2$ and 0.6 mg/cm$^2$, the deposited toner thickness "t" is constant, i.e., almost 11 μm, and the peak value PM relative to the reflection reference level $L_R$ is constant, i.e., 0.05, while the bottom value BM relative to the reflection reference level $L_R$ is 0.3, 0.8 and 1.6, respectively.

In FIG. 6A, when the deposited toner amount W is 0 mg/cm$^2$ in the area determining region ADR, the deposited toner thickness "t" is 0 μm, and the peak value PM is also 0. Therefore, the bottom value BM relative to the reflection reference level $L_R$ is also 0.

Figure 7:
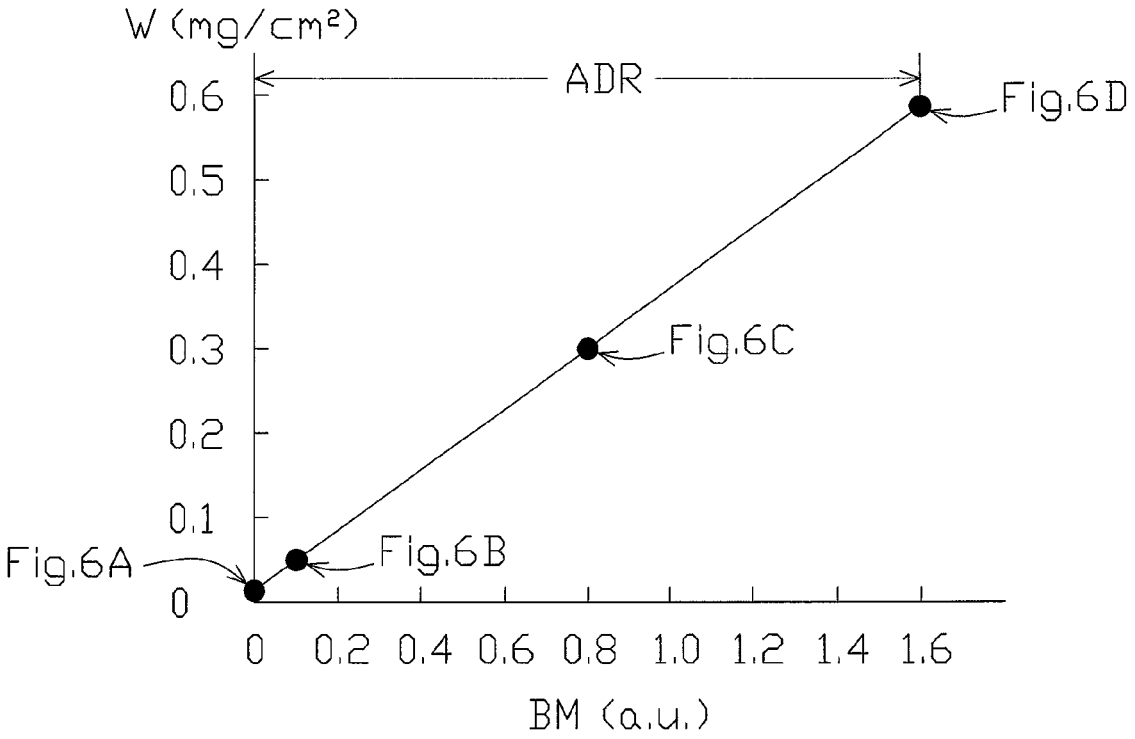
FIG. 7 is a graph for explaining a relationship between the bottom value of the sense voltage of the optical sensor of FIG. 3 and the deposited toner amount in an area determining region.

Thus, in the area determining region ADR as illustrated in FIG. 7, the deposited toner amount W has a BM-to-W linear relationship with the bottom value BM of the optical sensor 8.

Also, the deposited toner amount W of the cyan toner patch 72 has a BC-to-W linear relationship with the bottom value BC of the optical sensor 8 similar to the BM-to-W linear relationship as illustrated in FIG. 7, the deposited toner amount W of the yellow toner patch 73 has a BY-to-W linear relationship with the bottom value BY of the optical sensor 8 similar to the BM-to-W linear relationship as illustrated in FIG. 7, and the deposited toner amount W of the black toner patch 74 has a BB-to-W linear relationship with the bottom value BB of the optical sensor 8 similar to the BM-to-W linear relationship as illustrated in FIG. 7.

The above-mentioned linear relationships of deposited toner amounts W with the bottom values BM, BC, BY and BB of the sense voltage $V_s$ of the optical sensor 8 are stored in advance in the ROM 92 (see FIG. 8) of the control unit 9 of FIG. 1.

Figure 8:
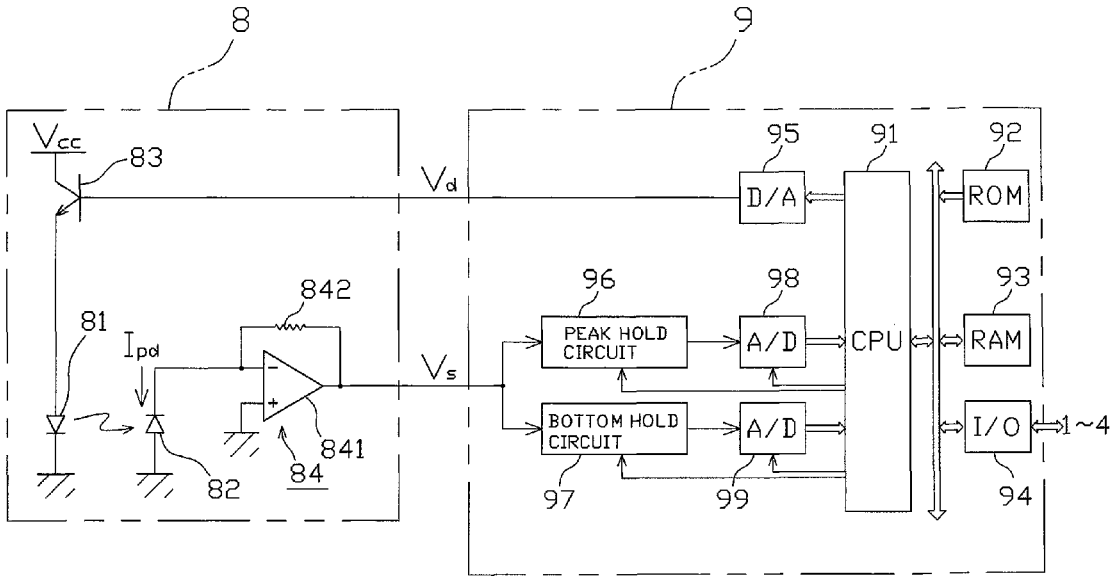
FIG. 8 is a circuit diagram of the optical sensor and the control unit of FIG. 1.

FIG. 8 is a detailed circuit diagram of the optical sensor 8 and the control unit 9 serving as the deposited toner amount measuring apparatus U1 of FIG. 1.

In FIG. 8, the optical sensor 8 includes a drive transistor 83 and an amplifier 84 formed by an operational amplifier 841 with a negative feedback resistor 842 in addition to the LED element 81 and the PD element 82. The drive transistor 83 is controlled by the drive voltage $V_d$ of the control unit 9. A photocurrent $I_{pd}$ flowing through the PD element 82 is transformed by the amplifier 84 into the sense voltage $V_s$:

$$V_s = R_f I_{pd}$$

where $R_f$ is a resistance value of the negative feedback resistor 842.

The control unit 9 is constructed by a microcomputer which includes a central processing unit (CPU) 91, a read-only memory (ROM) 92 such as a flash memory for storing programs, constants and the like, a random access memory (RAM) 93 for storing temporary data, an input/output interface (I/O) connected to the image forming units 1, 2, 3 and 4, a digital/analog (D/A) converter 95 for generating the drive voltage $V_d$ of the drive transistor 83, a peak hold circuit 96 for holding the peak value PM, PC or PY of the sense voltage $V_s$, a bottom hold circuit 97 for holding the bottom value BM, BC, BY or BB of the sense voltage $V_s$, an analog/digital (A/D) converter 98 for performing an A/D conversion upon the peak value PM, PC or PY of the peak hold circuit 96, and an A/D converter 99 for performing an A/D conversion upon the bottom value BM, BC, BY or BB of the bottom hold circuit 97.

Figure 9:
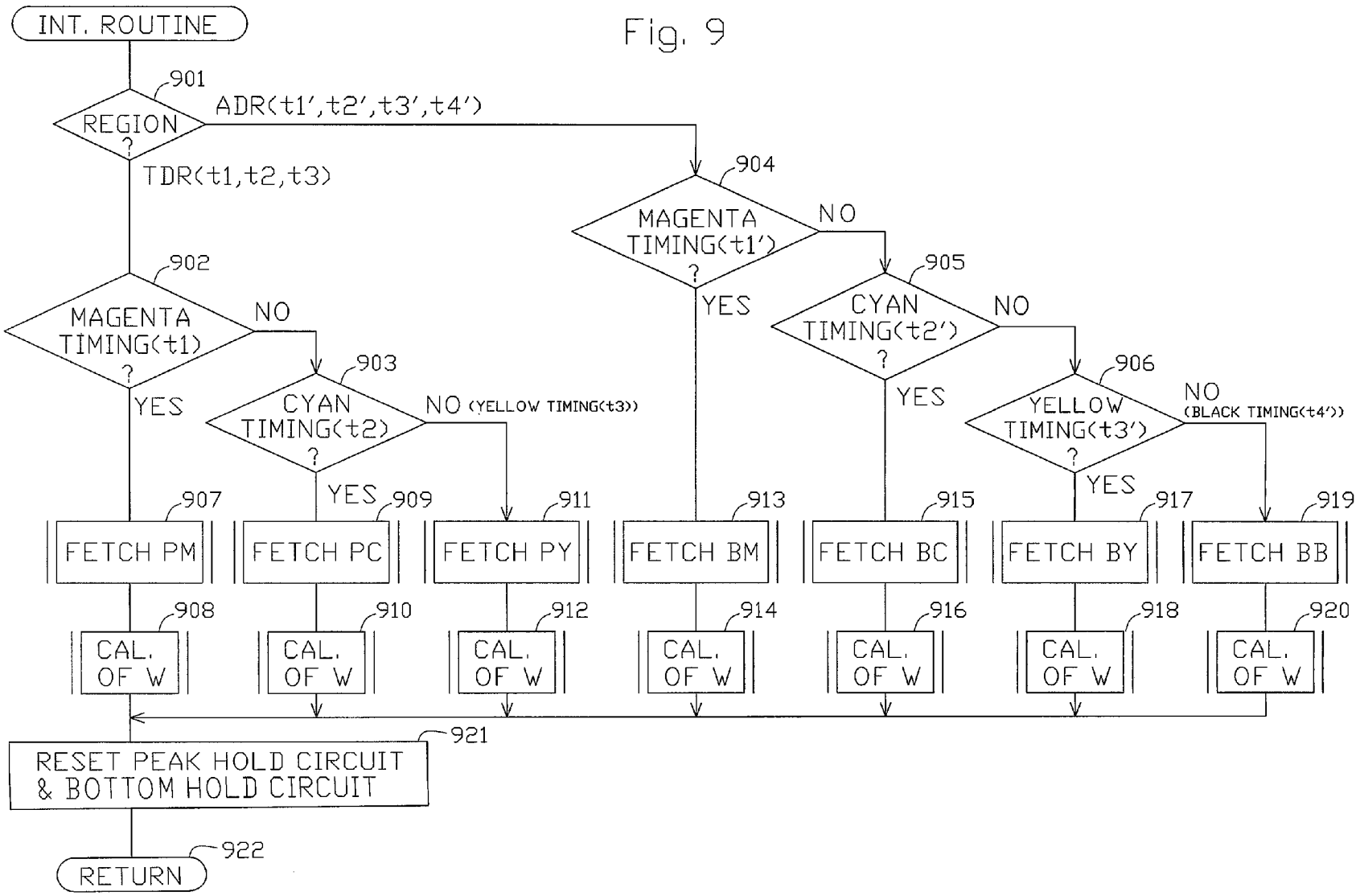
FIG. 9 is a flowchart for explaining the operation of the control unit of FIG. 8.

FIG. 9 is a flowchart for explaining the operation of the control unit 9 of FIG. 8, that is stored in the ROM 92 of FIG. 8. The flowchart is started at predetermined interrupt timings which are determined in advance by seven toner patches formed on the transfer belt 5 of FIG. 1 and the speed of the transfer belt 5. For example, as illustrated in FIG. 10A, in a thickness determining region TDR (W≥0.6 mg/cm$^2$), a last timing t1 of a magenta peak measuring period T1, a last timing t2 of a cyan peak measuring period T2 and a last timing t3 of a yellow peak measuring period T3 are predetermined interrupt timings. Also, as illustrated in FIG. 10B, in an area determining region ADR (W<0.6 mg/cm$^2$), a last timing t1' of a magenta bottom measuring period T1', a last timing t2' of a cyan bottom measuring period T2', a last timing t3' of a yellow bottom measuring period T3' and a last timing t4' of a black bottom measuring period T4' are predetermined interrupt timings.

As explained above, the flowchart of FIG. 9 is started at the interrupt timings t1, t2, t3, t3' and t4'. In this case, the drive transistor 83 is turned ON to generate the drive voltage $V_d$ in advance by a routine (not shown).

First, at steps 901 to 906, it is determined whether the current timing is t1, t2, t3, t3' or t4'.

If the current timing is t1, that is a magenta timing in the thickness determining region TDR, the flow proceeds from step 901 via step 902 to step 907 which fetches a peak value PM of a magenta toner patch 71 by performing an A/D conversion upon the output of the peak hold circuit 96. Then, at step 908, the CPU 91 calculates a deposited toner amount W by performing an interpolation upon the PM-to-W linear relationship stored in the ROM 92 using a positive relative value PM (=PM−$L_R$). Then, at step 921, the peak hold circuit 96 and the bottom hold circuit 97 are reset to the reflection reference level $L_R$, thus completing the flow at step 922.

If the current timing is t2, that is a cyan timing in the thickness determining region TDR, the flow proceeds from step 901 via steps 902 and 903 to step 909 which fetches a peak value PC of a cyan toner patch 72 by performing an A/D conversion upon the output of the peak hold circuit 96. Then, at step 910, the CPU 91 calculates a deposited toner amount W by performing an interpolation upon the PC-to-W linear relationship stored in the ROM 92 using a positive relative value PC (=PC−$L_R$). Then, at step 921, the peak hold circuit 96 and the bottom hold circuit 97 are reset to the reflection reference level $L_R$, thus completing the flow at step 922.

If the current timing is t3, that is a yellow timing in the thickness determining region TDR, the flow proceeds from step 901 via steps 902 and 903 to step 911 which fetches a peak value PY of a yellow toner patch 73 by performing an A/D conversion upon the output of the peak hold circuit 96. Then, at step 912, the CPU 91 calculates a deposited toner amount W by performing an interpolation upon the PY-to-W linear relationship stored in the ROM 92 using a positive relative value PY (=PY−$L_R$). Then, at step 921, the peak hold circuit 96 and the bottom hold circuit 97 are reset to the reflection reference level $L_R$, thus completing the flow at step 922.

If the current timing is t1', that is a magenta timing in the area determining region ADR, the flow proceeds from step 901 via step 904 to step 913 which fetches a bottom value BM of a magenta toner patch 71' by performing an A/D conversion upon the output of the bottom hold circuit 97. Then, at step 914, the CPU 91 calculates a deposited toner amount W by performing an interpolation upon the BM-to-W linear relationship stored in the ROM 92 using a positive relative value BM (=$L_R$−BM). Then, at step 921, the peak hold circuit 96 and the bottom hold circuit 97 are reset to the reflection reference level $L_R$, thus completing the flow at step 922.

If the current timing is t2', that is a cyan timing in the area determining region ADR, the flow proceeds from step 901 via steps 904 and 905 to step 915 which fetches a bottom value BC of a cyan toner patch 72' by performing an A/D conversion upon the output of the bottom hold circuit 97. Then, at step 916, the CPU 91 calculates a deposited toner amount W by performing an interpolation upon the BC-to-W linear relationship stored in the ROM 92 using a positive relative value BC (=$L_R$−BC). Then, at step 921, the peak hold circuit 96 and the bottom hold circuit 97 are reset to the reflection reference level $L_R$, thus completing the flow at step 922.

If the current timing is t3', that is a yellow timing in the area determining region ADR, the flow proceeds from step 901 via steps 904, 905 and 906 to step 917 which fetches a bottom value BY of a yellow toner patch 73' by performing an A/D conversion upon the output of the bottom hold circuit 97. Then, at step 918, the CPU 91 calculates a deposited toner amount W by performing an interpolation upon the BY-to-W linear relationship stored in the ROM 92 using a positive relative value BY (=$L_R$−BY). Then, at step 921, the peak hold circuit 96 and the bottom hold circuit 97 are reset to the reflection reference level $L_R$, thus completing the flow at step 922.

If the current timing is t4', that is a black timing in the area determining region ADR, the flow proceeds from step 901 via steps 904, 905 and 906 to step 919 which fetches a bottom value BB of a black toner patch 74' by performing an A/D conversion upon the output of the bottom hold circuit 97. Then, at step 920, the CPU 91 calculates a deposited black toner amount W by performing an interpolation upon the BB-to-W linear relationship stored in the ROM 92 using a positive relative value BB (=$L_R$−BB). Then, at step 921, the peak hold circuit 96 and the bottom hold circuit 97 are reset to the reflection reference level $L_R$, thus completing the flow at step 922.

The control unit 9 fine-adjusts the magenta image forming unit 1 in accordance with the calculated deposited magenta toner amounts W of the magenta toner patches 71 and 71'; fine-adjusts the cyan image forming unit 2 in accordance with the calculated deposited cyan toner amounts W of the cyan toner patches 72 and 72'; fine-adjusts the yellow image forming unit 3 in accordance with the calculated deposited yellow toner amounts W of the yellow toner patches 73 and 73'; and fine-adjusts the black image forming unit 4 in accordance with the calculated deposited black toner amounts W of the black toner patches 74 and 74'.

Figure 11:
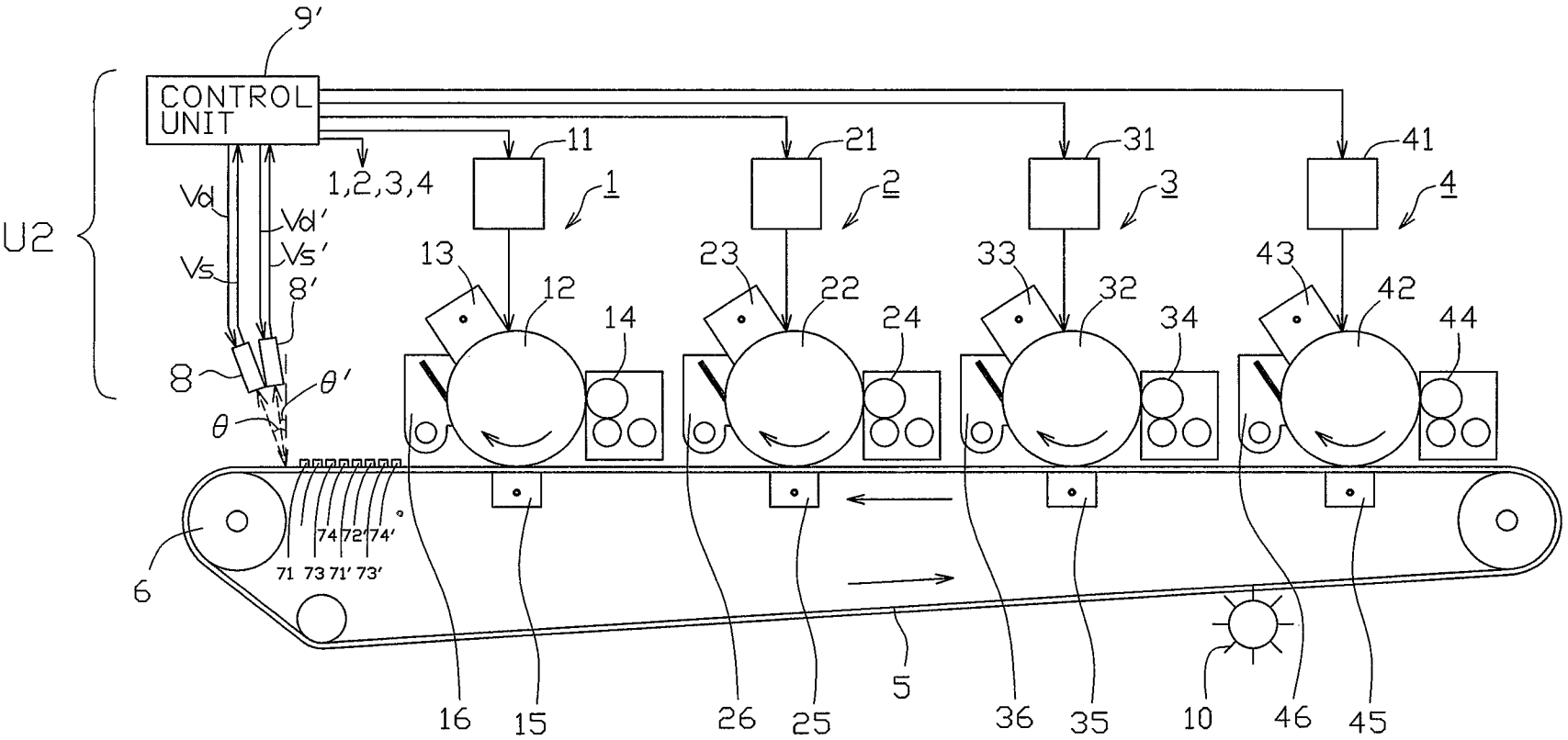
FIG. 11 is a diagram illustrating a multi-color image forming apparatus including a second embodiment of the deposited toner amount measuring apparatus according to the presently disclosed subject matter.

In FIG. 11, which illustrates a multi-color image forming apparatus such as a four-drum color laser beam printer including a second embodiment of the deposited toner amount measuring apparatus according to the presently disclosed subject matter, a compensating optical sensor 8' is added to the optical sensor 8 of FIG. 1, and a control unit 9' is provided instead of the control unit 9 of FIG. 1.

The compensating optical sensor 8' has a similar configuration to the optical sensor 8. That is, an intersection between a light outgoing and incoming plane of the compensating optical sensor 8' and a surface of the transfer belt 5 is perpendicular to the direction of propagation of the transfer belt 5, i.e., the magenta toner patch 71, the cyan toner patch 72, the yellow toner patch 73, the magenta toner patch 71', the cyan toner patch 72', the yellow toner patch 73' and the black toner patch 74'. Also, the light outgoing and incoming plane PL is inclined at a mounting angle θ' toward the direction of propagation of the transfer belt 5 with respect to a plane including the above-mentioned intersection. Thus, the compensating optical sensor 8' is strongly subject to light reflected from leading edges of the toner patches 71, 72, 73, 74, 71', 72', 73' and 74', but is less subject to light reflected from the transfer belt 5. In this case, the mounting angle θ' of the compensating optical sensor 8' is smaller than the mounting angle θ of the optical sensor 8, i.e., $$\theta' < \theta$$

where the mounting angle θ is 5° to 7°, preferably, 5°, in the same way as in the first embodiment; and the mounting angle θ' is 1° to 2°, preferably, 1°.

Figure 17:
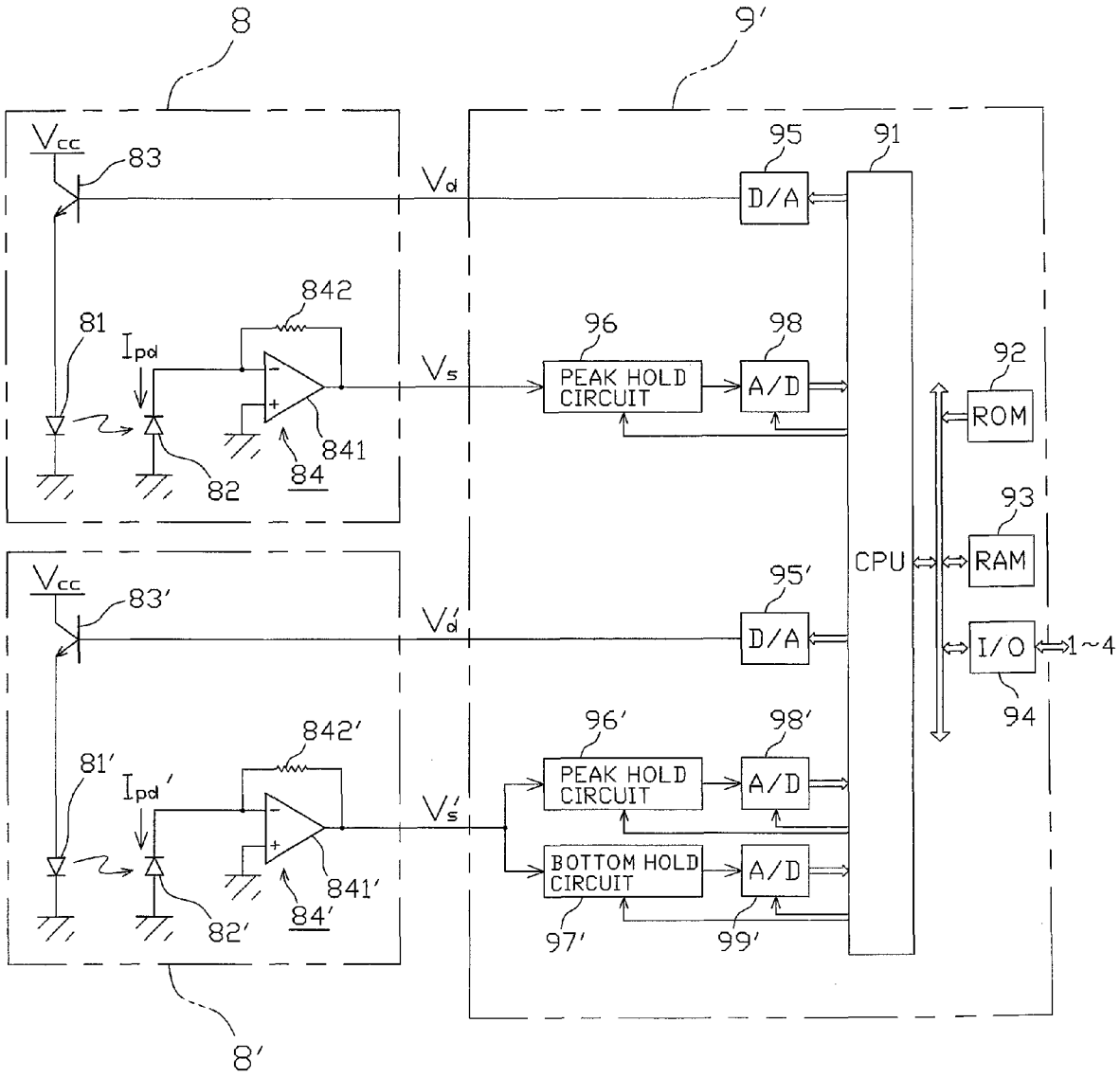
FIG. 17 is a circuit diagram of the optical sensor, the compensating optical sensor and the control unit of FIG. 11.

Note that the intersection by the compensating optical sensor 8' on the transfer belt 5 does not always coincide with the intersection by the optical sensor 8 on the transfer belt 5. Even if the two intersections are departed from each other on the transfer belt 5, i.e., even if the peak value of the sense voltage $V_s$ and the peak value of and the sense voltage $V_s'$ are not synchronized with each other, the two peak values can completely be obtained by the peak hold circuits 96 and 96' (see: FIG. 17).

Figure 12A:
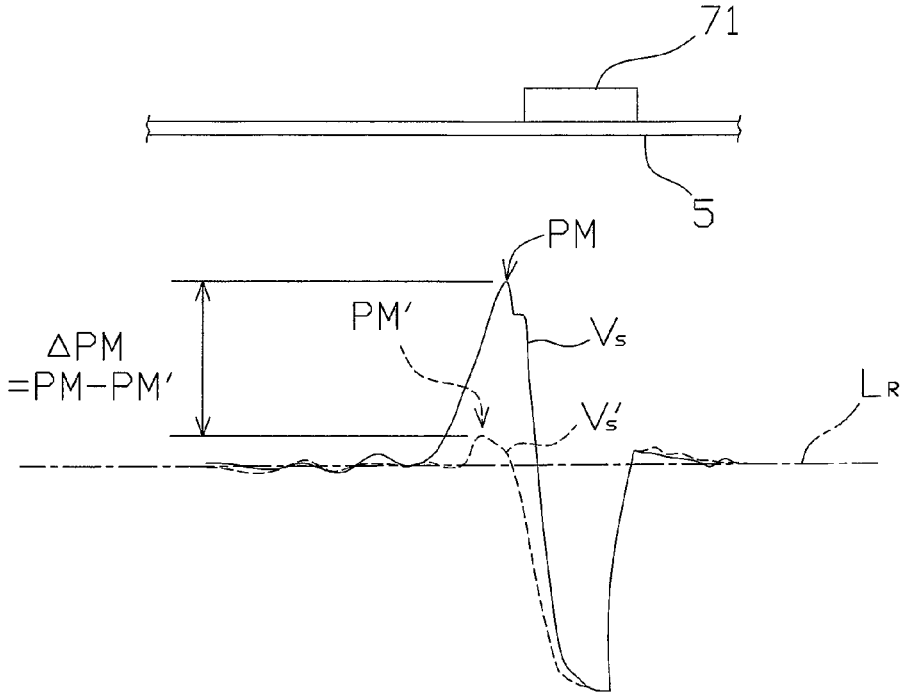
FIGS. 12A and 12B are timing diagrams of the sense voltage of the optical sensor and the sense voltage of the compensating optical sensor of FIG. 11 for the magenta toner patch in the thickness determining region.
Figure 12B:
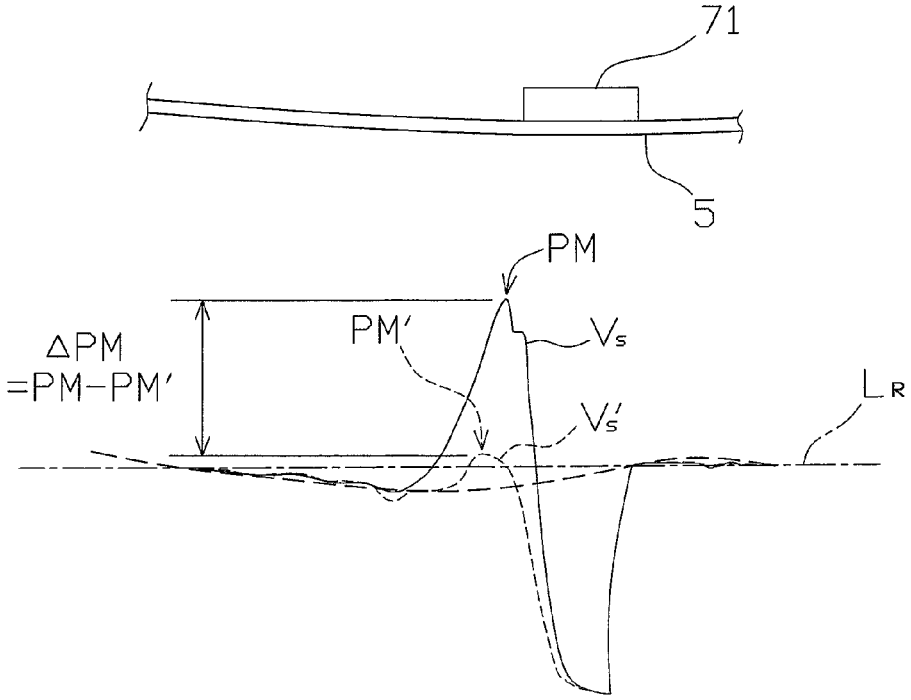

FIGS. 12A and 12B are timing diagrams of the sense voltage $V_s$ of the optical sensor 8 and the sense voltage $V_s'$ of the compensating optical sensor 8' of FIG. 11 for the magenta toner patch 71 in the thickness determining region TDR. Note that FIG. 12A corresponds to a case without the fluttering of the transfer belt 5, while FIG. 12B corresponds to a case with the fluttering of the transfer belt 5.

Figure 13:
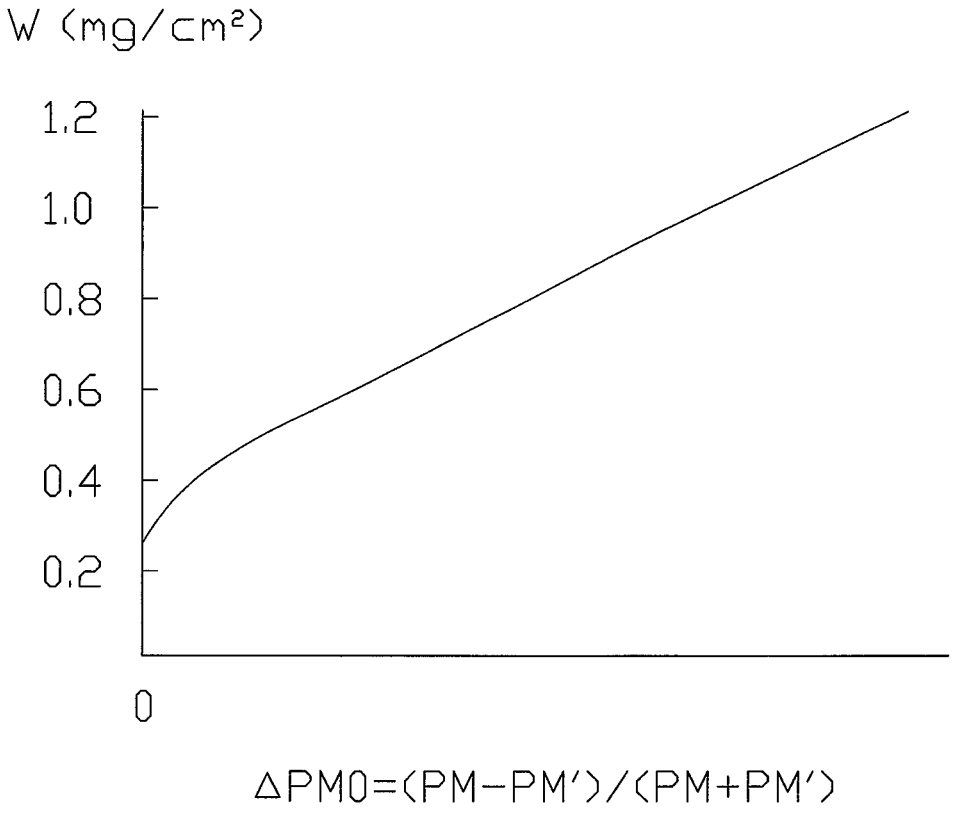
FIG. 13 is a graph for explaining a relationship of the difference the peak value of the sense voltage of the optical sensor and the output voltage of the compensating optical sensor of FIG. 11 with the deposited toner amount in a thickness determining region.

As illustrated in FIGS. 12A and 12B, the sense voltage $V_s$ of the optical sensor 8 and the sense voltage $V_s'$ of the compensating optical sensor 8' are subject to the fluttering of the transfer belt 5. On the other hand, the difference $\Delta V_s$ (=$V_s$−$V_s'$) between the sense voltage $V_s$ and the sense voltage $V_s'$ is not subject to the fluttering of the transfer belt 5. In other words, the difference $\Delta V_s$ (=$V_s$−$V_s'$) between the sense voltage $V_s$ and the sense voltage $V_s'$ is constant regardless of the fluttering of the transfer belt 5. Note that this difference $\Delta V_s$ (=$V_s$−$V_s'$) is constant regardless of the wavelike movement or roughness of the transfer belt 5. Therefore, in the second embodiment of FIG. 11, ΔPM (=PM−PM') is used instead of the peak value PM. In this case, as illustrated in FIG. 13, in order to exhibit a more linear relationship with the deposited magenta toner amount W, the following value ΔPM0 is used instead of PM:

$$\Delta PM0=(PM-PM')/(PM+PM')$$

where PM' is the peak value of the sense voltage $V_s'$ of a magenta toner patch. Similarly, in order to exhibit a more linear relationship with the deposited cyan toner amount W, the following value ΔPC0 is used instead of PC:

$$\Delta PC0=(PC-PC')/(PC+PC')$$

where PC' is the peak value of the sense voltage $V_s'$ of a cyan toner patch. Similarly, in order to exhibit a more linear relationship with the deposited yellow toner amount W, the following value ΔPY0 is used instead of PY:

$$\Delta PY0=(PY-PY')/(PY+PY')$$

where PY' is the peak value of the sense voltage $V_s'$ of a yellow toner patch.

Note that ΔPM0-to-W, ΔPC0-to-W and ΔPY0-to-W linear relationships between the values ΔPM0, ΔPC0 and ΔPY0 and their deposited toner amounts W are stored in the ROM of the control unit 9'.

Figure 14A:
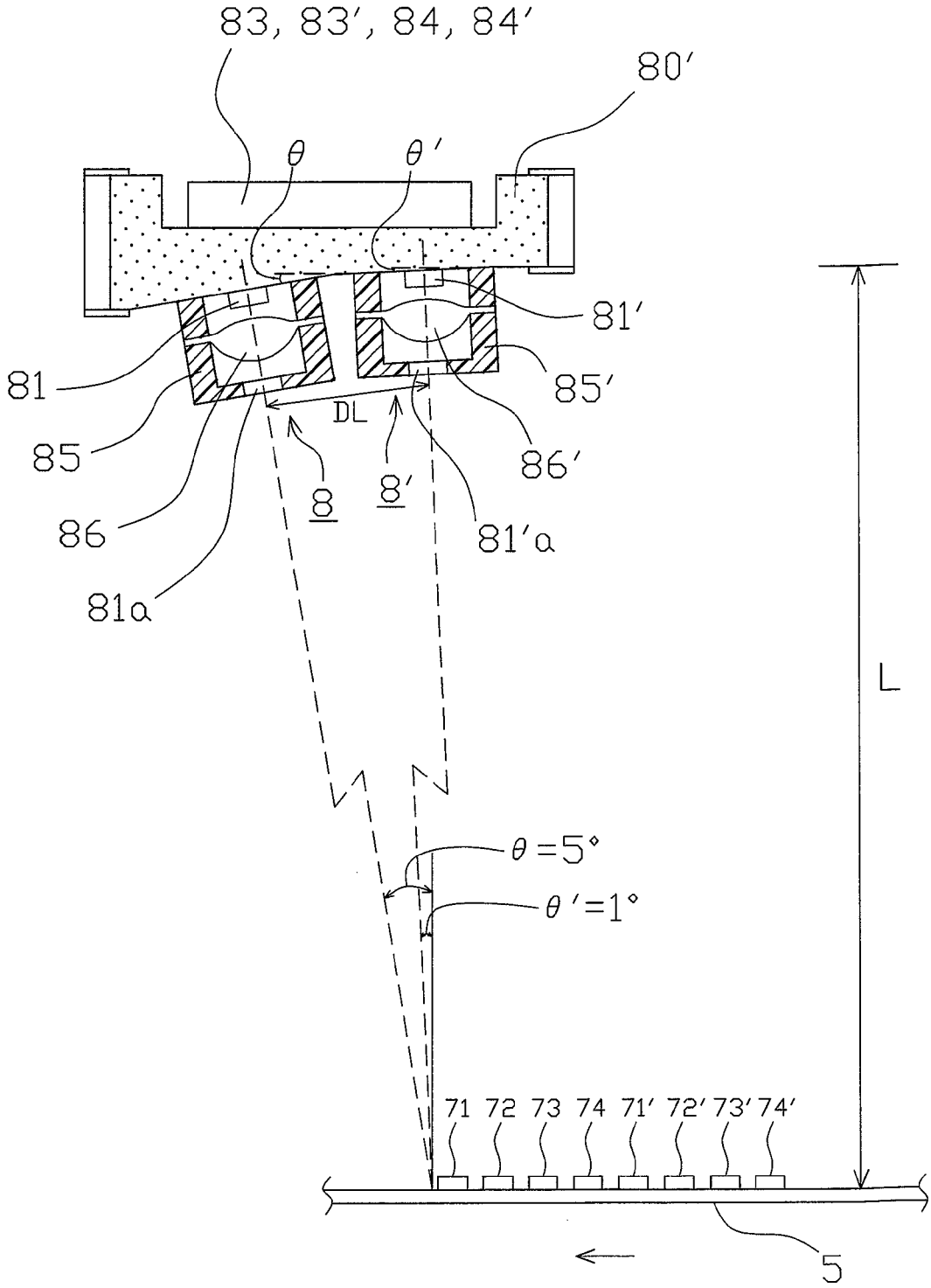
FIG. 14A is a cross-sectional view of a first example of the optical sensor and the compensating optical sensor of FIG. 11.
Figure 14B:
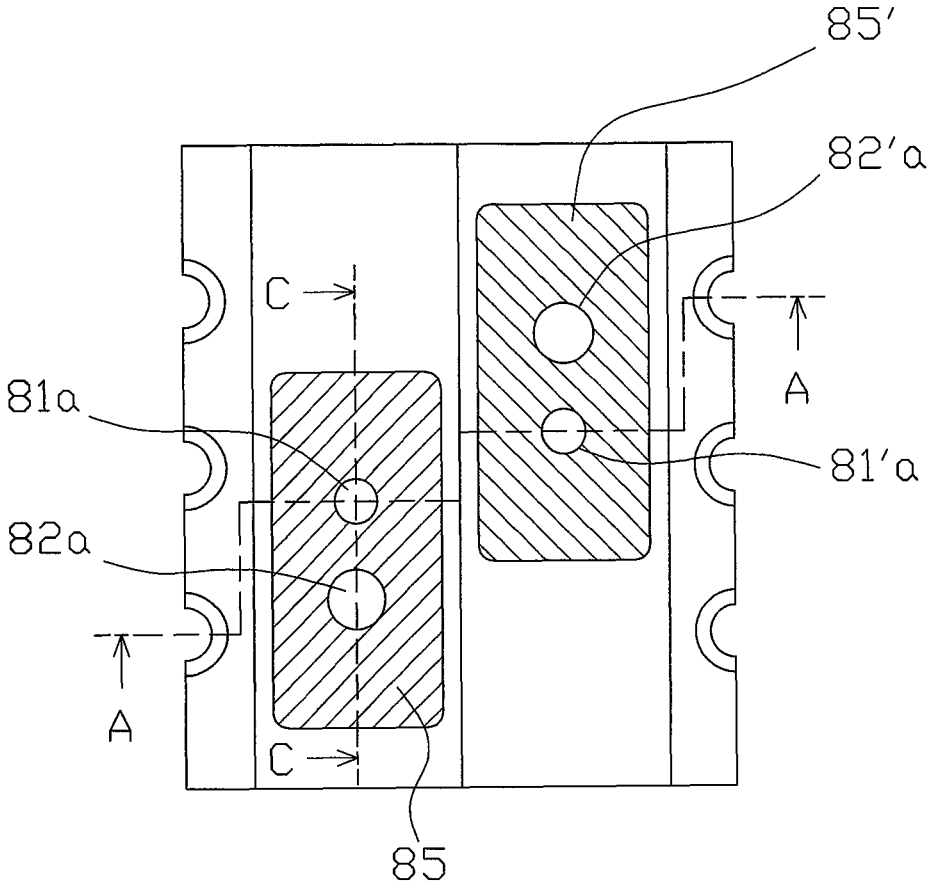
FIG. 14B is a bottom view of the first example of FIG. 14A.
Figure 14C:
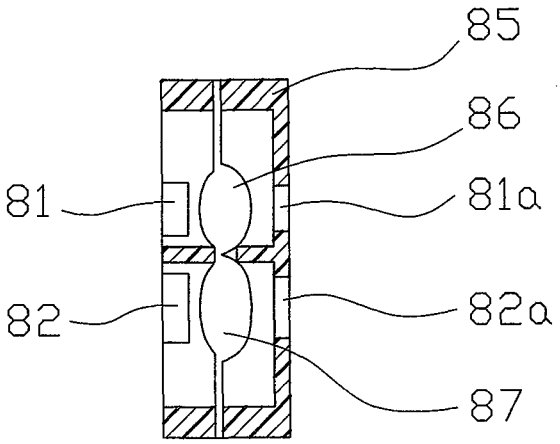
FIG. 14C is a cross-sectional view taken along the line C-C of FIG. 14B.

FIG. 14A is a cross-sectional view of a first example of the optical sensor 8 and the compensating optical sensor 8' of FIG. 11, FIG. 14B is a bottom view of the first example of FIG. 14A, and FIG. 14C is a cross-sectional view taken along the line C-C of FIG. 14B. Note that FIG. 14A is a cross-sectional view taken along the line A-A of FIG. 14B.

As illustrated in FIGS. 14A, 14B and 14C, the optical sensor 8 and the compensating optical sensor 8' are mounted on a common base 80' which has two surfaces, i.e., a θ-sloped surface and a θ'-sloped surface. The LED element 81 and the PD element 82 (or a phototransistor element) of the optical sensor 8 are mounted on a θ-sloped surface of the common base 80', and are coated by a transparent resin layer (not shown). Also, the LED element 81 and the PD element 82 are surrounded by a shield 85 to thereby prevent stray light from being penetrated in the PD element 82. Similarly, the compensating optical sensor 8' has an LED element 81' and a PD element 82' (or a phototransistor element) which are mounted on a θ'-sloped surface of the common base 80', and are coated by a transparent resin layer (not shown). Also, the LED element 81' and the PD element 82' are surrounded by a shield 85' to thereby prevent stray light from being penetrated into the PD element 82'. Also, condenser lenses 86, 86', 87 and 87' (the lenses 87 and 87' are not shown) are provided at intermediate portions of the shields 85 and 85', and also, apertures 81*a* and 81'*a* for outgoing light and apertures 82*a* and 82'*a* for incoming light are provided at the bottoms of the shields 85 and 85'.

Also, the compensating optical sensor 8' has a drive transistor 83' and an amplifier 84' similar to the drive transistor 83 and the amplifier 84, respectively, of the optical sensor 8.

The drive transistors 83 and 83' and the amplifiers 84 and 84' are provided in recesses at the rear side of the common base 80'.

DL is a distance between the optical axes of the optical sensor 8 and the compensating optical sensor 8'. In FIG. 14A, the mounting angle θ of the light outgoing and incoming face of including the optical axes of the LED element 81 and the PD element 82 of the optical sensor 8 with respect to an intersectional face perpendicular to the direction of propagation of the transfer belt 5 is 5°. On the other hand, the mounting angle θ' of the light outgoing and incoming face of including the optical axes of the LED element 81' and the PD element 82' of the compensating optical sensor 8' with respect to an intersectional face perpendicular to the direction of propagation of the transfer belt 5 is 1°. Therefore, in this case, the distance DL can be represented by $$DL=L\cdot\tan 4°$$

where L is a distance between the transfer belt 5 and the optical sensor 8 and the compensating optical sensor 8'.

Figure 15A:
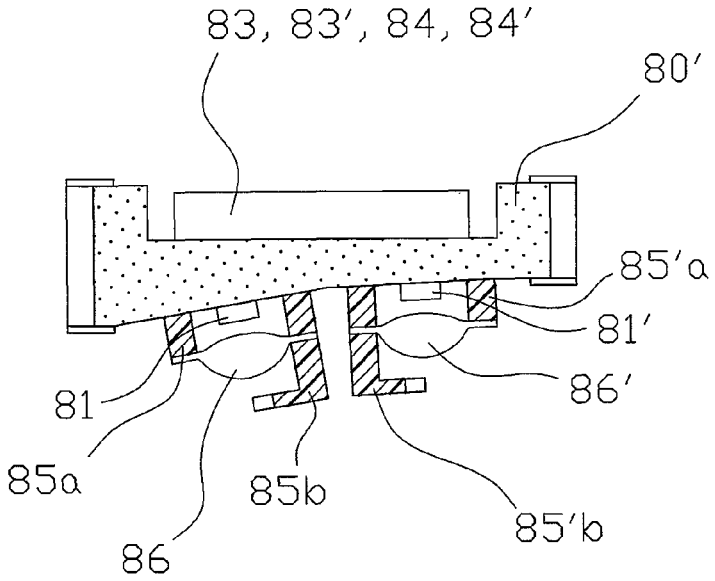
FIG. 15A is a cross-sectional view illustrating a modification of the first example of FIG. 14A.
Figure 15B:
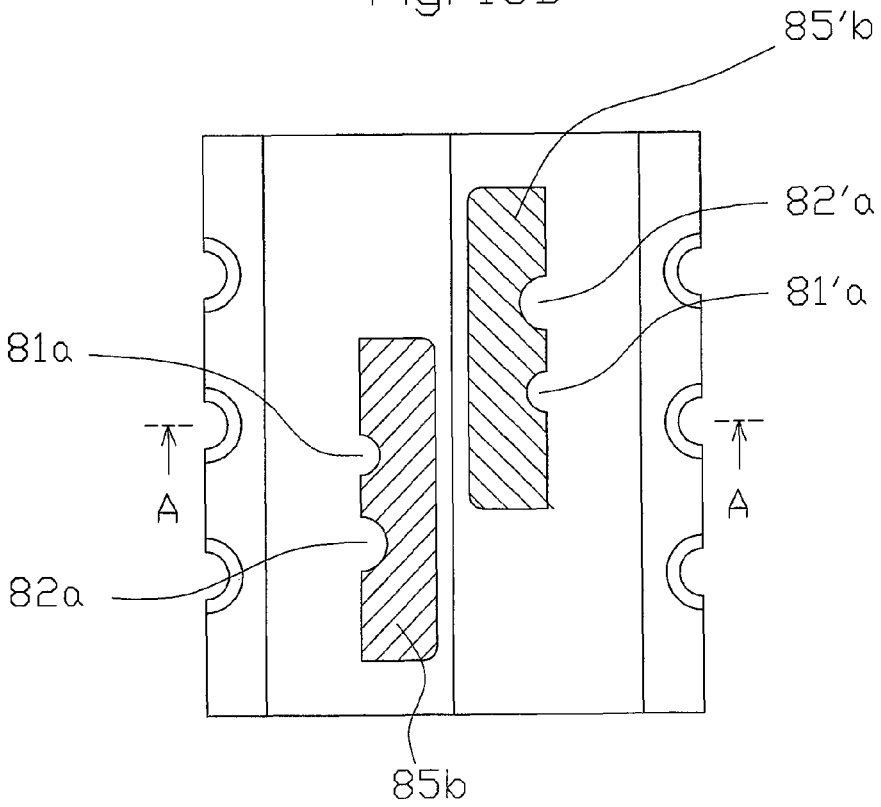
FIG. 15B is a bottom view of the modification of FIG. 15A.

FIG. 15A is a cross-sectional view illustrating a modification of the first example of FIG. 14A, and FIG. 15B is a bottom view of the modification of FIG. 15A. Note that FIG. 15A is a cross-sectional view taken along the A-A line of FIG. 15A.

As illustrated in FIGS. 15A and 15B, the shield 85 and the shield 85' of FIGS. 14A, 14B and 14C are replaced by shields 85*a* and 85*b* and shields 85'*a* and 85'*b*, where the shields 85*b* and 85'*b* are opened, so that the apertures 81*a*, 82*a*, 81'*a* and 82'*a* are semi-circular. In this case, the preventing effect of stray light from being penetrated into the PD elements 82 and 82' could not deteriorate. Thus, when the optical sensor 8 and the compensating optical sensor 8' have deteriorated due to the adhesion of toner particles or contamination thereto, it is easy to clean the optical sensor 8 and the compensating optical sensor 8'.

Figure 16A:
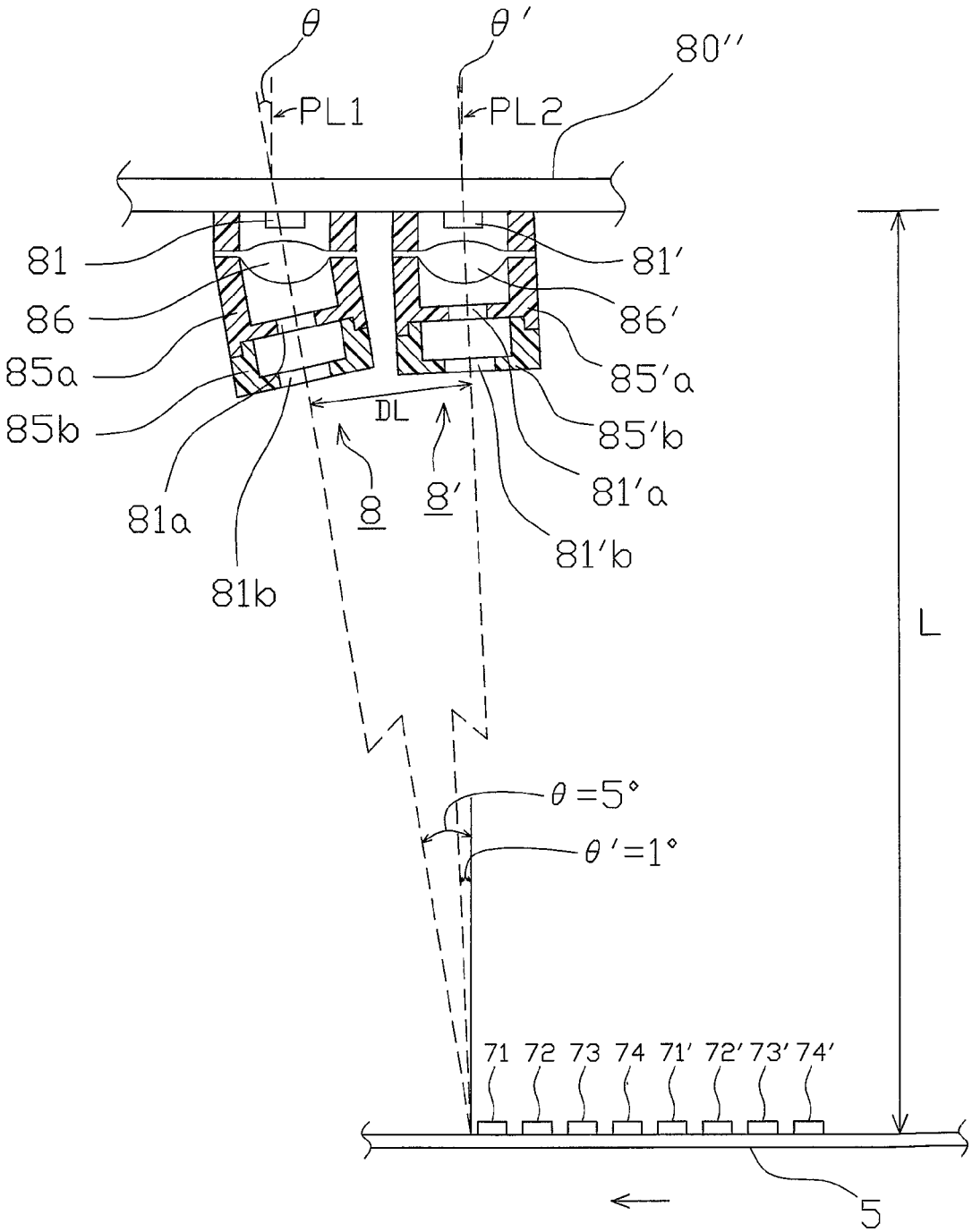
FIG. 16A is a cross-sectional view of a second example of the optical sensor and the compensating optical sensor of FIG. 11.
Figure 16B:
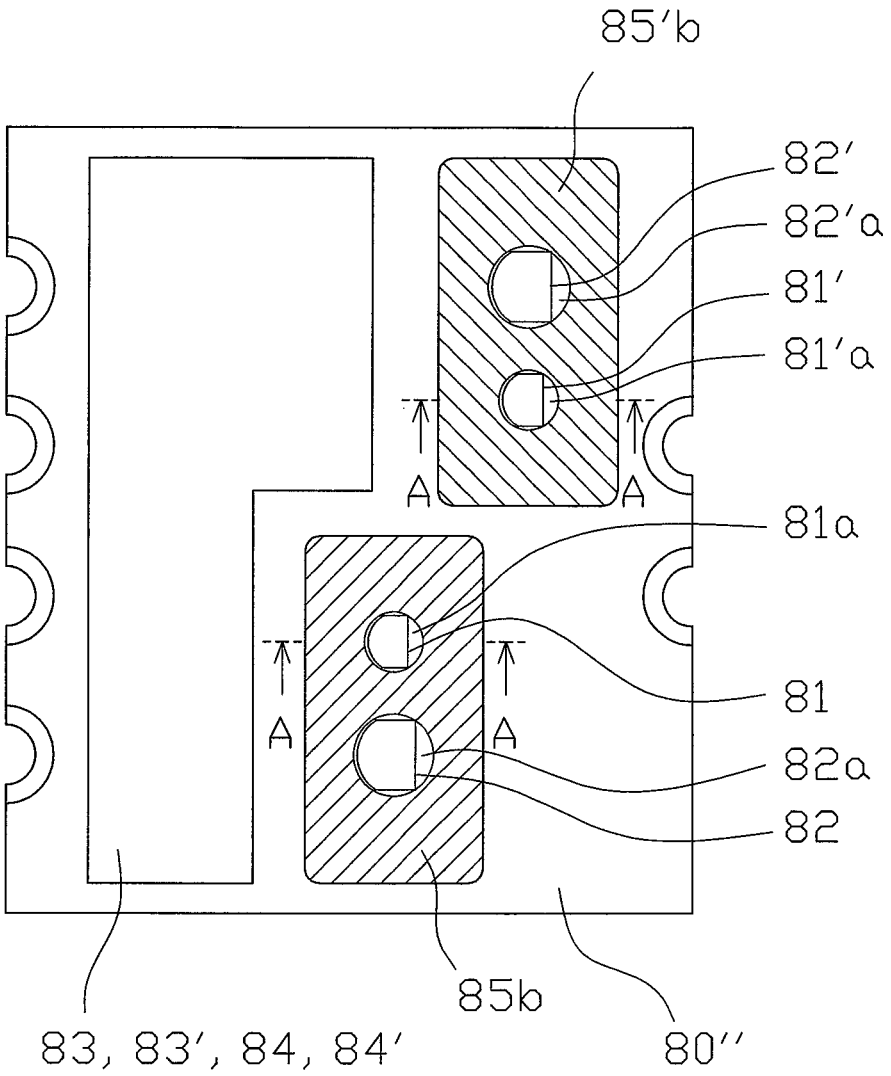
FIG. 16B is a bottom view of the second example of FIG. 16A.

FIG. 16A is a cross-sectional view of a second example of the optical sensor 8 and the compensating optical sensor 8' of the compensating optical sensor 8' of FIG. 11, and FIG. 16B is a bottom view of the second example of FIG. 16A. Note that FIG. 16A is a cross-sectional view taken along the line A-A of FIG. 16B.

As illustrated in FIGS. 16A and 16B, the optical sensor 8 and the compensating optical sensor 8' are mounted on a common organic or ceramic substrate base 80". The LED element 81 and the PD element 82 (or a phototransistor element) of the optical sensor 8 are mounted on a surface of the substrate 80", and are coated by a transparent resin layer (not shown). Also, the LED element 81 and the PD element 82 are surrounded by shields 85*a* and 85*b* to thereby prevent stray light from being penetrated into the PD element 82. Similarly, the LED element 81' and the PD element 82' of the compensating optical sensor 8' are mounted on the surface of the substrate 80", and are coated by a transparent resin layer (not shown). Also, the LED element 81' and the PD element 82' are surrounded by shields 85'*a* and 85'*b* to thereby prevent stray light from being penetrated into the PD element 82'. Also, the condenser lenses 86, 86', 87 and 87' (the lenses 87 and 87' are not shown) are provided on the shields 85*a* and 85'*a*, and also, apertures 81*a* and 81*b* and 81'*a* and 81'*b* (the apertures 81*b* and 81'*b* are not shown) for outgoing light and apertures 82*a* and 82*b* and 82'*a* and 82'*b* (the apertures 82*b* and 82'*b* are not shown) for incoming light are provided on the shields 85*a* and 85'*a*.

The optical axes of the optical sensor 8 are determined by the apertures 81*a*, 81*b*, 82*a* and 82*b* and are inclined at the mounting angle θ with respect to a perpendicular PL1 of the substrate 80". Also, the optical axes of the compensating optical sensor 8' are determined by the apertures 81'*a*, 81'*b*, 82'*a* and 82'*b* and are inclined at the mounting angle θ' with respect to a perpendicular PL2 of the substrate 80".

The drive transistors 83 and 83' and the amplifiers 84 and 84' are provided on the substrate 80".

In FIGS. 16A and 16B, since the optical sensor 8 and the compensating optical sensor 8' are mounted on the same surface of the substrate 80", the distance DL between the optical sensor 8 and the compensating optical sensor 8' can be decreased as compared with that as illustrated in FIG. 14A, so that the length L (=DL/tan 4°) between the transfer belt 5 and the optical sensor 8 and the compensating optical sensor 8' can be decreased as compared with that in FIG. 14A. As a result, if the detection are D of the optical sensor 8 and the compensating optical sensor 8' in FIG. 16A is the same as in FIG. 14A, the spread of the outgoing light of each of the LED elements 81 and 81' and the spread of the incoming light of each of the PD elements 82 and 82' can be increased as compared with those in FIG. 14A. Thus, the assembling tolerance of the apertures 81*a*, 81*b*, 82*a*, 82*b*, 81'*a*, 81'*b*, 82'*a*, 82'*b*, the shields 85*a*, 85*b*, 85'*a* and 85'*b* and the condensing lenses 86, 86', 87 and 87' can be increased, which would decrease the manufacturing cost.

FIG. 17 is a detailed circuit diagram of the optical sensor 8, the compensating optical sensor 8' and the control unit 9' serving as the deposited toner amount measuring apparatus U2 of FIG. 11. Note that the circuit of the optical sensor 8 is the same as that of the optical sensor 8 illustrated in FIG. 8.

In the same way as in the optical sensor 8, the compensating optical sensor 8' includes a drive transistor 83' and an amplifier 84' formed by an operational amplifier 841' and a feedback resistor 842' in addition to the LED element 81' and the PD element 82'. The drive transistor 83' is controlled by the drive voltage $V_d'$ of the control unit 9'. A photocurrent $I_{pd}'$ flowing through the PD element 82' is transformed by the amplifier 84' into the sense voltage $V_s'$:

$$V_s'=R_f'\cdot I_{pd}'$$

where $R_f'$ is the resistance value of the feedback resistor 842'.

In the control unit 9', since the bottom value of the sense voltage $V_s$ is unnecessary, the bottom hold circuit 97 and the A/D converter 99 of FIG. 8 are not provided. Note that the compensating optical sensor 8' can serve as a better regular reflection sensor than the optical sensor 8. Therefore, the bottom values BM', BC', BY' and BB' of the sense voltage $V_s'$ of the compensating optical sensor 8' is used for calculating deposited toner amounts W in the area determining region ATR. In this case, a BM'-to-W linear relationship, a BC'-to-W linear relationship, a BY'-to-W linear relationship and a BB'-to-W linear relationship similar to the BM-to-W linear relationship as illustrated in FIG. 7 are stored in the ROM 92 of FIG. 17 in advance. However, the optical sensor 8 still can serve as a regular reflection sensor. Therefore, the bottom values BM, BC, BY and BB of the optical sensor 8 may be used instead of the bottom values BM', BC', BY' and BB' of the compensating optical sensor 8'.

Due to the addition of the compensating optical sensor 8', the control unit 9' further includes D/A converter 95' for generating the drive voltage $V_d'$ of the drive transistor 83', a peak hold circuit 96' for holding the peak value PM, PC or PY of the sense voltage $V_s'$, a bottom hold circuit 97' for holding the bottom value BM', BC', BY' or BB' of the sense voltage $V_s'$, an A/D converter 98' for performing an A/D conversion upon the peak value PM', PC' or PY' of the peak hold circuit 96', and an A/D converter 99' for performing an A/D conversion upon the bottom value BM', BC', BY' or BB' of the bottom hold circuit 97'.

Figure 18:
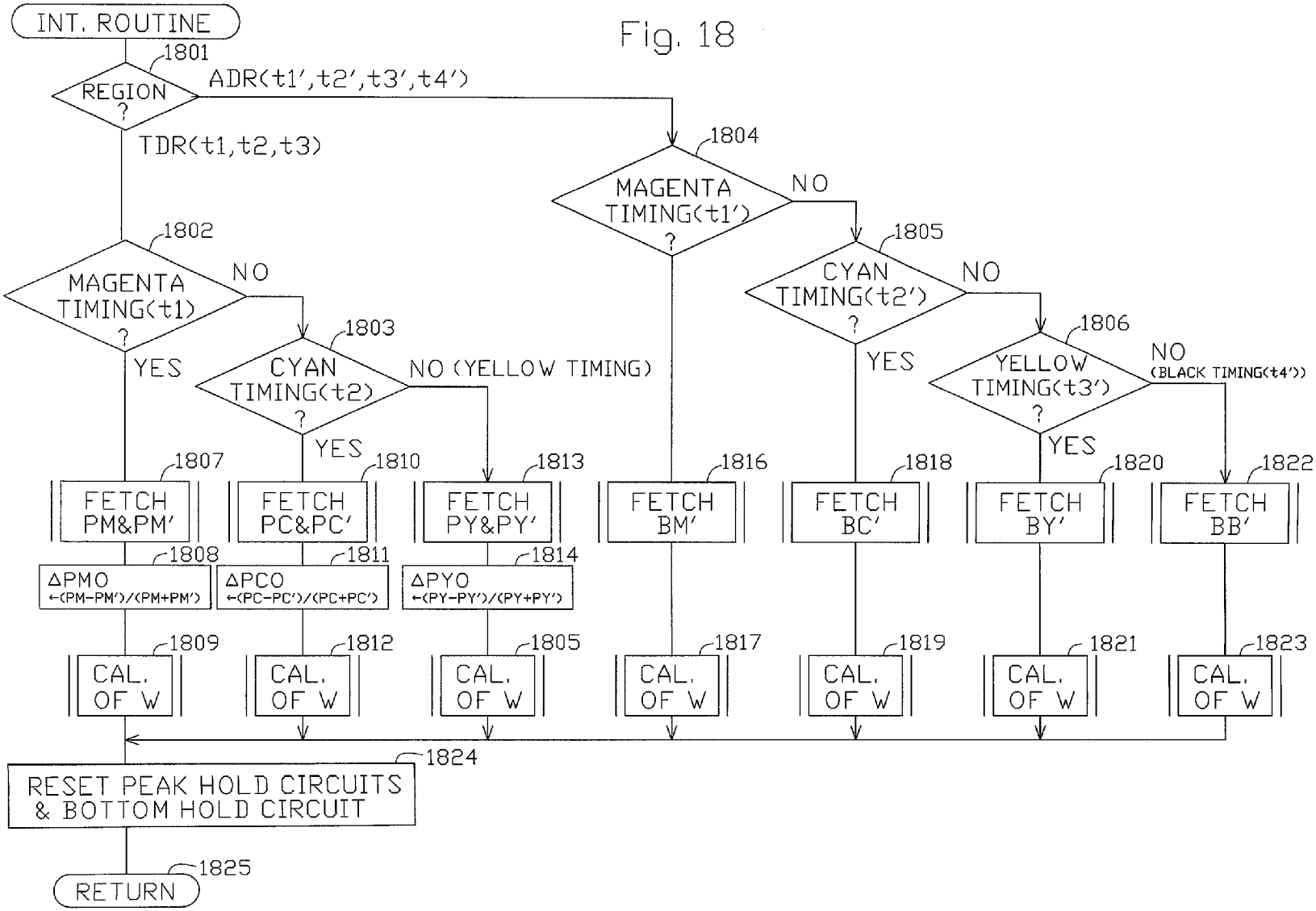
FIG. 18 is a flowchart for explaining the operation of the control unit of FIG. 17.
Figures 19A, 19B, 19C:
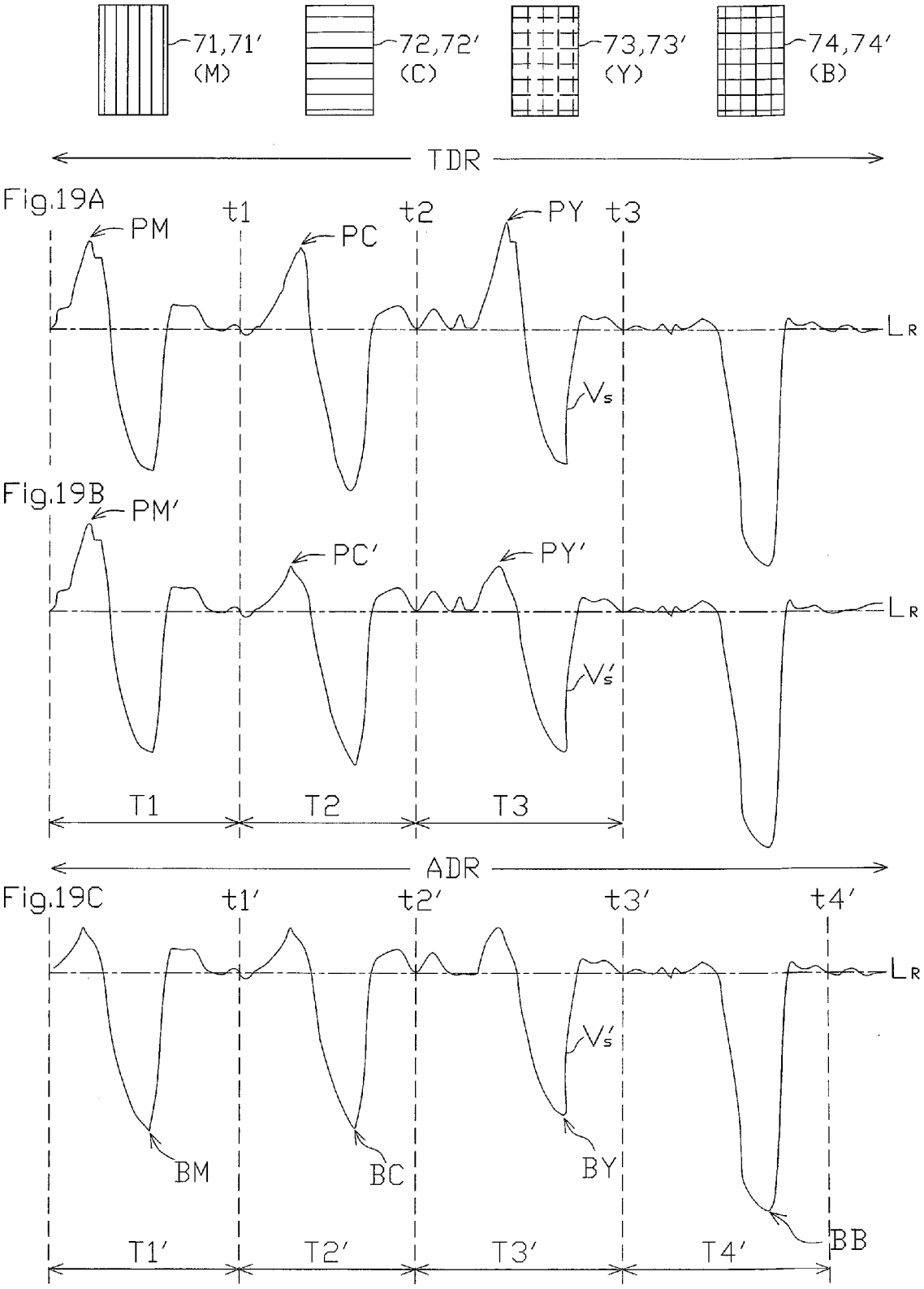
FIG. 19A is a timing diagram of the sense voltage of the optical sensor for supplementing the operation of FIG. 18 in the thickness determining region.
FIG. 19B is a timing diagram of the sense voltage of the compensating optical sensor for supplementing the operation of FIG. 18 in the thickness determining region.
FIG. 19C is a timing diagram of the sense voltage of the optical sensor for supplementing the operation of FIG. 18 in the area determining region.

FIG. 18 is a flowchart for explaining the operation of the control unit 9' of FIG. 17, that is stored in the ROM 92 of FIG. 17. The flowchart is started at predetermined interrupt timings which are determined in advance by seven toner patches formed on the transfer belt 5 of FIG. 11 and the speed of the transfer belt 5. For example, as illustrated in FIGS. 19A and 19B, in a thickness determining region TDR (W≥0.6 mg/cm$^2$), a last timing t1 of a magenta peak measuring period T1, a last timing t2 of a cyan peak measuring period T2 and a last timing t3 of a yellow peak measuring period T3 are predetermined interrupt timings. Also, as illustrated in FIG. 19C, in an area determining region ADR (W<0.6 mg/cm$^2$), a last timing t1' of a magenta bottom measuring period T1', a last timing t2' of a cyan bottom measuring period T2', a last timing t3' of a yellow bottom measuring period T3' and a last timing t4' of a black bottom measuring period T4' are predetermined interrupt timings.

As explained above, the flowchart of FIG. 18 is started at the interrupt timings t1, t2, t3, t3' and t4'. In this case, the drive transistors 83 and 83' are turned ON to generate the drive voltages $V_d$ and $V_d'$ in advance by a routine (not shown).

First, at steps 1801 to 1806, it is determined whether the current timing is t1, t2, t3, t3' or t4'. If the current timing is t1, that is a magenta timing in the thickness determining region TDR, the flow proceeds from step 1801 via step 1802 to step 1807 which fetches a peak value PM of a magenta toner patch 71 and a peak value PM' of a magenta toner patch 71' by performing A/D conversions upon the outputs of the peak hold circuits 96 and 96'. Then, at step 2008, the CPU 91 calculates a value ΔPM0 by $$\Delta PM0\leftarrow(PM-PM')/(PM+PM')$$

Then, at step 1809, the CPU 91 calculates a deposited toner amount W by performing an interpolation upon the ΔPM0-to-W linear relationship stored in the ROM 92 using the value ΔPM0. Then, at step 1809, the peak hold circuits 96 and 96' and the bottom hold circuit 97' are reset to the reflection reference level $L_R$, thus completing the flow at step 1825.

If the current timing is t2, that is a cyan timing in the thickness determining region TDR, the flow proceeds from step 1801 via steps 1802 and 1803 to step 1810 which fetches peak values PC and PC' of cyan toner patches 72 and 72' by performing A/D conversions upon the outputs of the peak hold circuits 96 and 96'. Then, at step 1811, the CPU 91 calculates a value ΔPC0 by $$\Delta PC0\leftarrow(PC-PC')/(PC+PC')$$

Then, at step 1812, the CPU 91 calculates a deposited toner amount W by performing an interpolation upon the ΔPC0-to-W linear relationship stored in the ROM 92 using the value ΔPC0. Then, at step 1812, the peak hold circuits 96 and 96' and the bottom hold circuit 97' are reset to the reflection reference level $L_R$, thus completing the flow at step 1822.

If the current timing is t3, that is a yellow timing in the thickness determining region TDR, the flow proceeds from step 1801 via steps 1802 and 1803 to step 1813 which fetches peak values PY and PY' of yellow toner patches 73 and 73' by performing A/D conversions upon the outputs of the peak hold circuits 96 and 96'. Then, at step 2014, the CPU 91 calculates a value ΔPY0 by $$\Delta PY0\leftarrow(PY-PY')/(PY+PY')$$

Then, at step 1815, the CPU 91 calculates a deposited toner amount W by performing an interpolation upon the ΔPY0-to-W linear relationship stored in the ROM 92 using the value ΔPY0. Then, at step 1824, the peak hold circuits 96 and 96' and the bottom hold circuit 97' are reset to the reflection reference level $L_R$, thus completing the flow at step 1825.

If the current timing is t1', that is a magenta timing in the area determining region ADR, the flow proceeds from step 1801 via step 1804 to step 1816 which fetches a bottom value BM' of a magenta toner patch 71' by performing an A/D conversion upon the output of the bottom hold circuit 97'. Then, at step 1817, the CPU 91 calculates a deposited toner amount W by performing an interpolation upon the BM'- to-W linear relationship stored in the ROM 92 using a positive relative value BM' (=$L_R$−BM'). Then, at step 1824, the peak hold circuits 96 and 96' and the bottom hold circuit 97' are reset to the reflection reference level $L_R$, thus completing the flow at step 1825.

If the current timing is t2', that is a cyan timing in the area determining region ADR, the flow proceeds from step 1801 via steps 1804 and 1805 to step 1818 which fetches a bottom value BC' of a cyan toner patch 72' by performing an A/D conversion upon the output of the bottom hold circuit 97'. Then, at step 1819, the CPU 91 calculates a deposited toner amount W by performing an interpolation upon the BC'-to-W linear relationship stored in the ROM 92 using a positive relative value BC' (=$L_R$−BC'). Then, at step 1824, the peak hold circuits 96 and 96' and the bottom hold circuit 97' are reset to the reflection reference level $L_R$, thus completing the flow at step 1825.

If the current timing is t3', that is a yellow timing in the area determining region ADR, the flow proceeds from step 1801 via steps 1804, 1805 and 1806 to step 1820 which fetches a bottom value BY' of a yellow toner patch 73' by performing an A/D conversion upon the output of the bottom hold circuit 97'. Then, at step 1821, the CPU 91 calculates a deposited toner amount W by performing an interpolation upon the BY'-to-W linear relationship stored in the ROM 92 using a positive relative value BY' (=$L_R$−BY'). Then, at step 1824, the peak hold circuits 96 and 96' and the bottom hold circuit 97' are reset to the reflection reference level $L_R$, thus completing the flow at step 1825.

If the current timing is t4', that is a black timing in the area determining region ADR, the flow proceeds from step 1801 via steps 1804, 1805 and 1806 to step 1822 which fetches a bottom value BB' of a black toner patch 74' by performing an A/D conversion upon the output of the bottom hold circuit 97'. Then, at step 1821, the CPU 91 calculates a deposited black toner amount W by performing an interpolation upon the BB'-to-W linear relationship stored in the ROM 92 using a positive relative value BB' (=$L_R$−BB'). Then, at step 1824, the peak hold circuits 96 and 96' and the bottom hold circuit 97' are reset to the reflection reference level $L_R$, thus completing the flow at step 1825.

The control unit 9' fine-adjusts the magenta image forming unit 1 in accordance with the calculated deposited magenta toner amounts W of the magenta toner patches 71 and 71'; fine-adjusts the cyan image forming unit 2 in accordance with the calculated deposited cyan toner amounts W of the cyan toner patches 72 and 72'; fine-adjusts the yellow image forming unit 3 in accordance with the calculated deposited yellow toner amounts W of the yellow toner patches 73 and 73'; and fine-adjusts the black image forming unit 4 in accordance with the calculated deposited black toner amounts W of the black toner patches 74 and 74'.

Figure 20:
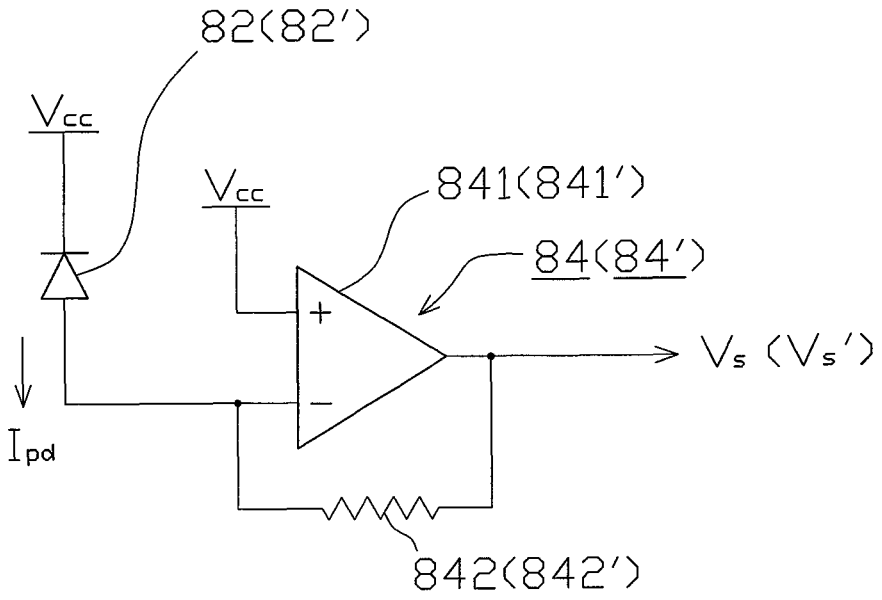
FIG. 20 is a circuit diagram illustrating a modification of the amplifier of FIGS. 8 and 17.
Figure 21:
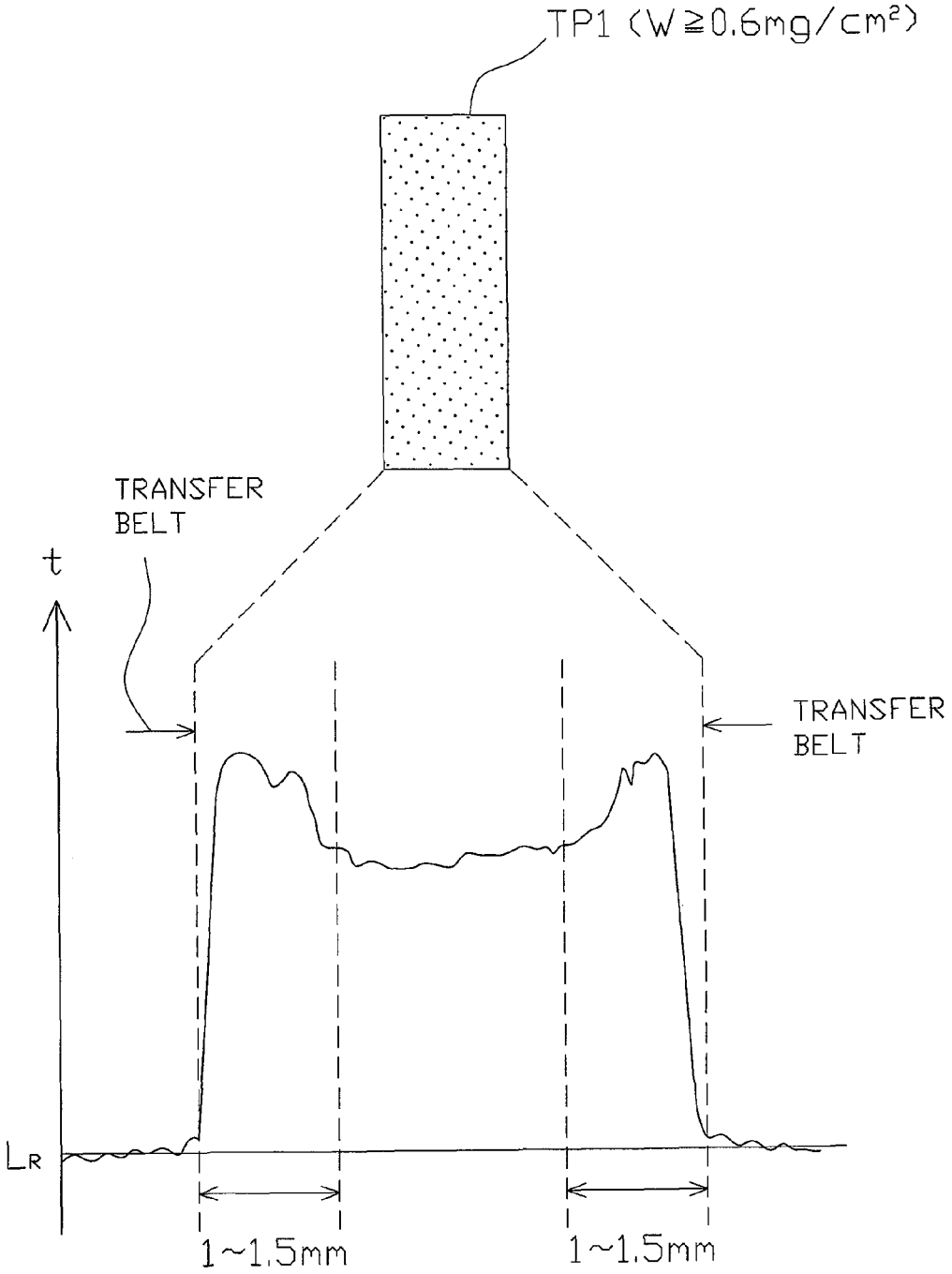
Fig. 21 PRIOR ART
FIG. 21 is a graph showing the thickness of deposited toner of a toner patch in a thickness determining region.
Figure 22:
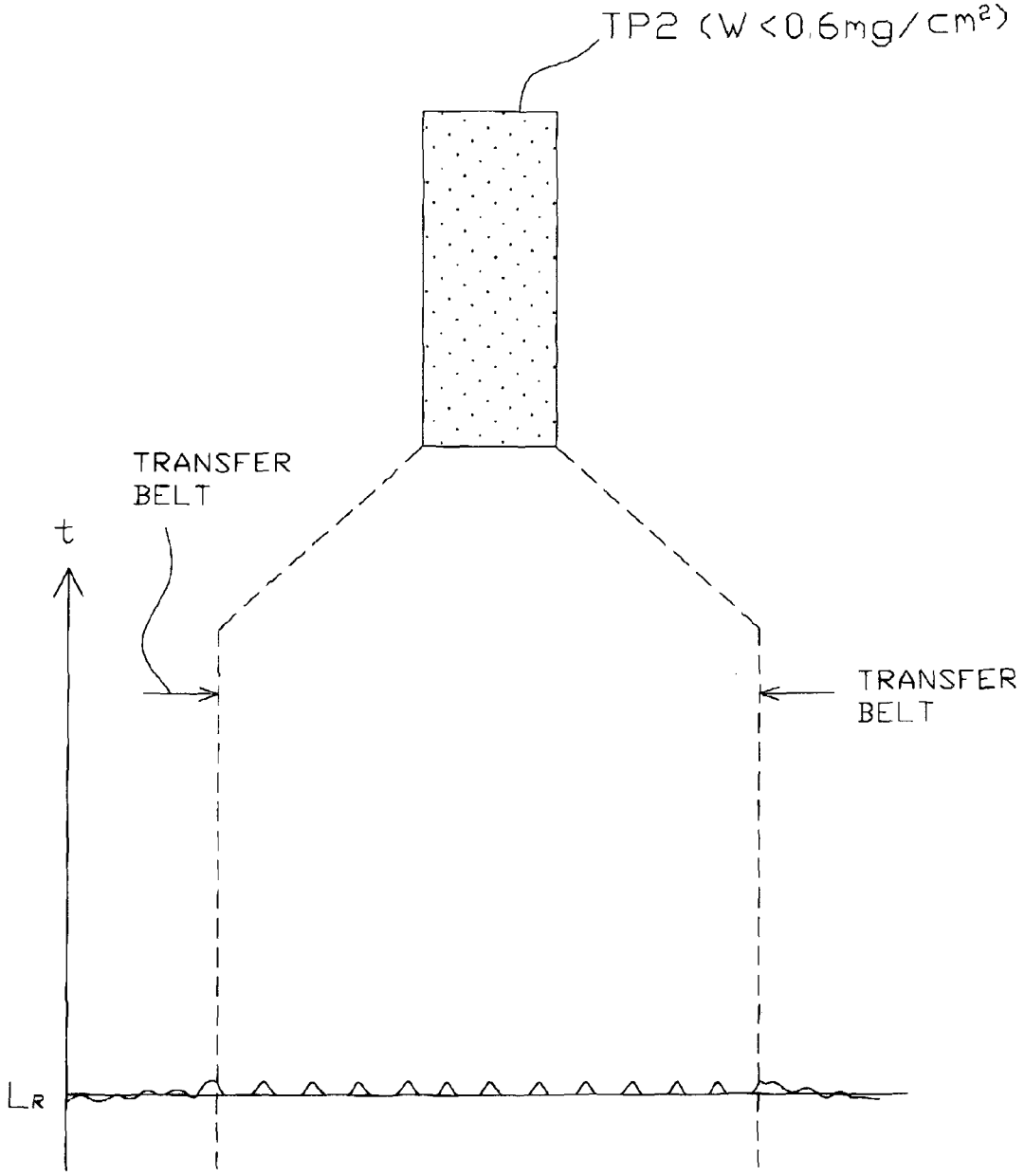
Fig. 22 PRIOR ART
FIG. 22 is a graph showing the thickness of deposited toner of a toner patch in an area determining region.

In the amplifier 84 (84') of FIG. 8 (FIG. 17), the PD element 82 (82') is connected between the ground and the negative-side input of the operational amplifier 842 (842'). Therefore, when a photocurrent $I_{pd}$ ($I_{pd}'$) flows through the PD element 82 (82'), the sense voltage $V_s$ ($V_s'$) rises. However, the amplifier 84 (84') can be modified into an amplifier as illustrated in FIG. 20 where the PD element 82 (82') is connected between a positive power supply terminal $V_{cc}$ and the negative-side input of the operational amplifier 842 (842'). In this case, when a photocurrent $I_{pd}$ ($I_{pd}'$) flows through the PD element 82 (82'), the sense voltage $V_s$ ($V_s'$) (=$V_{cc}-R_f \cdot I_{pd}$ or $V_{cc}-R_f' \cdot I_{pd}'$) falls. Thus, if the amplifier 84 (84') as illustrated in FIG. 20 is applied to the above-described embodiments, the peak values and the bottom values are replaced by bottom values and peak values, respectively, and the peak hold circuits and the bottom hold circuits are replaced by bottom hold circuits and peak hold circuits, respectively.

Also, in the above-described second embodiment, a first frequency of light emitted from the LED element 81 can be made different from a second frequency of light emitted from the LED element 81', and bandpass filters for passing the first and second frequencies therethrough can be provided on light receiving faces of the PD element 82 and 82', respectively. Thus, the operation of the optical sensor 8 can be separated from that of the compensating optical sensor 8'. In addition, the operations of the optical sensor 8 and the compensating optical sensor 8' can be time-divisionally carried out, so that the operation of the optical sensor 8 can be separated from that of the compensating optical sensor 8'.

It will be apparent to those skilled in the art that various modifications and variations can be made in the presently disclosed subject matter without departing from the spirit or scope of the presently disclosed subject matter. Thus, it is intended that the presently disclosed subject matter covers the modifications and variations of the presently disclosed subject matter provided they come within the scope of the appended claims and their equivalents. All related or prior art references described above and in the Background section of the present specification are hereby incorporated in their entirety by reference.

What is claimed is:

1. An apparatus for measuring a deposited toner amount of a toner patch formed on a toner carrier, comprising:

an optical sensor having a first light emitting portion and a first light receiving portion; and a control unit adapted to drive said first light emitting portion to receive a first sense voltage from said first light receiving portion, wherein a first intersection between a light outgoing and incoming plane including an optical axis of said first light emitting portion and said first light receiving portion and a surface of said toner carrier is perpendicular to a direction of propagation of said toner carrier, wherein said light outgoing and incoming plane is inclined at a first mounting angle toward the direction of propagation of said toner carrier with respect to a plane including said first intersection perpendicular to said toner carrier, wherein said control unit calculates said deposited toner amount in accordance with a first one of a first peak value and a first bottom value of said first sense voltage in a thickness determining region where said deposited toner amount is expected to be not smaller than a predetermined amount, and calculates said deposited toner amount in accordance with a second one of said first peak value and a first bottom value of said first sense voltage in an area determining region where said deposited toner amount is expected to be smaller than said predetermined amount.

2. The apparatus as set forth in claim 1, wherein said first mounting angle is 5° to 7°.

3. The apparatus as set forth in claim 1, further comprising:

a compensating optical sensor having a second light emitting portion and a second light receiving portion, wherein said control unit drives said second light emitting portion to receive a second sense voltage from said second light receiving portion, wherein a second intersection between a light outgoing and incoming plane including an optical axis of said second light emitting portion and said second light receiving portion and the surface of said toner carrier is perpendicular to the direction of propagation of said toner carrier, wherein said light outgoing and incoming plane is inclined at a second mounting angle smaller than said first mounting angle toward the direction of propagation of said toner carrier with respect to a plane including said second intersection perpendicular to said toner carrier, wherein said control unit calculates said deposited toner amount in accordance with a difference between the first one of said peak value and said bottom value of said first sense voltage and a first one of a peak value and a bottom value of said second sense voltage in said thickness determining region.

4. The apparatus as set forth in claim 3, wherein said second mounting angle is 1° to 2°.

5. The apparatus as set forth in claim 3, wherein the difference between the first one of said first peak value and said first bottom value of said first sense voltage and the first one of said second peak value and said second bottom value of said second sense voltage is represented by $$\Delta P0 \leftarrow (P-P')/(P+P')$$

where P is the first one of said first peak value and said first bottom value of said first sense voltage; and P' is the first one of said second peak value and said second bottom value of said second sense voltage.

6. The apparatus as set forth in claim 3, further comprising:

a common base having a first surface sloped at said first mounting angle and a second surface sloped at said second mounting angle, said optical sensor being mounted on said first surface of said common base, a compensating optical sensor being mounted on said second surface of said common base.

7. The apparatus as set forth in claim 3, further comprising:

a substrate on which said optical sensor and said compensating optical sensor are mounted;

a first shield with a first aperture sloped at said first mounting angle with respect to a first perpendicular of said substrate, said first shield surrounding said first light emitting portion and said first light receiving portion of said optical sensor; and a second shield with a second aperture sloped at said second mounting angle with respect to a second perpendicular of said substrate, said second shield surrounding said second light emitting portion and said second light receiving portion of said compensating optical sensor.

8. An apparatus for measuring a deposited toner amount of a toner patch formed on a toner carrier, comprising:

an optical sensor having a first light emitting portion and a first light receiving portion;

a compensating optical sensor having a second light emitting portion and a second light receiving portion; and a control unit adapted to drive said first light emitting portion to receive a first sense voltage from said first light receiving portion and adapted to drive said second light emitting portion to receive a second sense voltage from said second light receiving portion, wherein a first intersection between a light outgoing and incoming plane including an optical axis of said first light emitting portion and said first light receiving portion and a surface of said toner carrier is perpendicular to a direction of propagation of said toner carrier, wherein a second intersection between a light outgoing and incoming plane including an optical axis of said second light emitting portion and said second light receiving portion and the surface of said toner carrier is perpendicular to the direction of propagation of said toner carrier, wherein said light outgoing and incoming plane is inclined at a first mounting angle toward the direction of propagation of said toner carrier with respect to a plane including said first intersection perpendicular to said toner carrier, wherein said light outgoing and incoming plane is inclined at a second mounting angle smaller than said first mounting angle toward the direction of propagation of said toner carrier with respect to a plane including said second intersection perpendicular to said toner carrier, wherein said control unit calculates said deposited toner amount in accordance with a difference between a first one of a first peak value and a first bottom value of said first sense voltage and a first one of a first peak value and a first bottom value of said second sense voltage in a thickness determining region where said deposited toner amount is expected to be not smaller than a predetermined amount, and calculates said deposited toner amount in accordance with a second one of said second peak value and a second bottom value of said second sense voltage in an area determining region where said deposited toner amount is expected to be smaller than said predetermined amount.

9. The apparatus as set forth in claim 8, wherein said first mounting angle is 5° to 7°.

10. The apparatus as set forth in claim 8, wherein said second mounting angle is 1° to 2°.

11. The apparatus as set forth in claim 8, wherein the difference between the first one of said first peak value and said first bottom value of said first sense voltage and the first one of said second peak value and said second bottom value of said second sense voltage is represented by $$\Delta P0 \leftarrow (P-P')/(P+P')$$

where P is the first one of said first peak value and said first bottom value of said first sense voltage; and P' is the first one of said second peak value and said second bottom value of said second sense voltage.

12. The apparatus as set forth in claim 8, further comprising:

a common base having a first surface sloped at said first mounting angle and a second surface sloped at said second mounting angle, said optical sensor being mounted on said first surface of said common base, a compensating optical sensor being mounted on said second surface of said common base.

13. The apparatus as set forth in claim 8, further comprising:

a substrate on which said optical sensor and said compensating optical sensor are mounted;

a first shield with a first aperture sloped at said first mounting angle with respect to a first perpendicular of said substrate, said first shield surrounding said first light emitting portion and said first light receiving portion of said optical sensor; and a second shield with a second aperture sloped at said second mounting angle with respect to a second perpendicular of said substrate, said second shield surrounding said second light emitting portion and said second light receiving portion of said compensating optical sensor.

* * * * *